US005559545A

United States Patent [19]

Fuwa

[11] Patent Number: 5,559,545

[45] Date of Patent: Sep. 24, 1996

[54] PERFORATING DEVICE OF STAMP UNIT

[75] Inventor: Tetsuji Fuwa, Hashima, Japan

[73] Assignee: Brother Kogyo Kabushiki Kaisha, Nagoya, Japan

[21] Appl. No.: 578,232

[22] Filed: Dec. 26, 1995

[30] Foreign Application Priority Data

Jan. 27, 1995 [JP] Japan ..... 7-031494

[51] Int. Cl.[6] ..... B41J 2/32

[52] U.S. Cl. ..... 347/171; 347/186

[58] Field of Search ..... 101/121, 128.4, 101/128.21, 129, 125; 347/171, 186; 400/120.01, 120.08

[56] References Cited

U.S. PATENT DOCUMENTS

| | | | |
|---|---|---|---|
| 5,019,836 | 5/1991 | Iwata et al. | 347/186 |
| 5,184,549 | 2/1993 | Imamaki et al. | 101/121 |
| 5,251,567 | 10/1993 | Fuwa | 101/128.4 |
| 5,253,581 | 10/1993 | Miki et al. | 101/121 |

FOREIGN PATENT DOCUMENTS

| | | |
|---|---|---|
| 62-70079 | 3/1987 | Japan . |
| 2-204076 | 8/1990 | Japan . |

*Primary Examiner*—Huan H. Tran
*Attorney, Agent, or Firm*—Oliff & Berridge

[57] ABSTRACT

A perforating device used by a stamp unit for perforating a desired character string pattern on a print face portion of the stamp unit which incorporates an ink impregnation member covered with heat sensitive stencil paper including a thermoplastic film. The perforating device includes: a thermal head having a plurality of heating elements selectively powered and heated to reach a first temperature to melt the thermoplastic film and perforate the heat sensitive stencil paper based on the character string pattern. A moving mechanism moves the thermal head and the print face portion relative to each other after the thermal head has performed the perforation. A head driving circuit powers the heating elements to reach a second temperature lower than the first temperature while the thermal head and the print face portion are being moved by the moving mechanism relative to each other.

20 Claims, 22 Drawing Sheets

PERFORATING DEVICE OF STAMP UNIT

BACKGROUND OF THE INVENTION

1. Field of the Invention

The present invention relates to a perforating device used by a stamp unit for perforating a desired character string pattern on a print face portion of the stamp unit that incorporates an ink impregnation member, the underside of which is covered with heat sensitive stencil paper including a thermoplastic film. More particularly, the invention relates to a perforating device that prevents dregs of melted thermoplastic film from getting stuck to the heating elements of the thermal head when the thermoplastic film in the heat sensitive stencil paper is thermally perforated, whereby the heating elements are kept clean to constantly perforate unblurred character string patterns.

2. Description of Related Art

Perforating devices are known that utilize heating elements of a thermal head to thermally perforate a desired character string pattern on heat sensitive stencil paper including a thermoplastic film.

One such perforating device is disclosed in Japanese Patent Laid-Open No. Sho 62-70079, the subject matter of which is incorporated herein by reference. This device includes dot heating elements that heat a desired pattern in order to thermally perforate the thermoplastic film into dots constituting a thermally perforated portion of the film. While the dots are being made by heat, the thermoplastic film slidingly contacts the heating elements. After the dots are complete, ink is applied through the thermally perforated portion to form an image pattern on a recording medium. According to this recording method, the thermoplastic film slidingly contacts the dot-type heating elements as they are moved relative to each other to form the thermally perforated portion where the perforated holes are made even in diameter. This apparently allows the device to provide clear recording images.

The recording method disclosed in Japanese Patent Laid-Open No. Sho 62-70079, the subject matter of which is incorporated herein by reference, discusses the thermoplastic film slidingly contacting the heating elements as they are moved relative to each other to form the thermally perforated portion. This causes dregs of the melted plastic resin to accumulate at one end of the thermally perforated portion. Because the perforations are made instantaneously, the heating elements are generally heated to a temperature sufficiently higher than the melting temperature of the thermoplastic film. This causes dregs of the melted plastic resin to attach to the heating elements. As the heating elements rapidly cool, the melted plastic resin attached to the elements is likely to solidify thereon.

As a result, the heating elements remain soiled. The plastic resin is difficult to remove from the heating elements and therefore may lead to blunting of thermally made dot patterns. This results in significantly lower quality images.

To prevent the deterioration of the dot pattern requires keeping the surface of the heating elements clean. One such cleaning method is described in Japanese Patent Laid-Open No.. Hei 2-204076, the subject matter of which is incorporated herein by reference. This method involves having a cleaning material of thin fiber press against and slid along the thermal head while the thermal head is being heated.

However, the cleaning material used by the above cleaning method is only for cleaning the thermal head. That is, the material is not designed to clean the thermal head while thermal perforation is in operation. This cleaning material is periodically applied (independent of thermal perforation) after a predetermined amount (time) of perforations is carried out. In other words, thermal perforation cannot be performed while the thermal head is being cleaned. In addition, cleaning by the material takes place only upon completion of thermal perforation. If dregs of the melted plastic resin attach to the thermal head during the thermal perforation, the perforating operation must nevertheless proceed. This can entail the blunting of perforated patterns by the plastic resin that is melted and stuck. As a result, the cleaning method fails to eliminate degrading of the quality of dot pattern images formed by perforated film.

SUMMARY OF THE INVENTION

It is an object of the present invention to overcome the above-described disadvantages of the prior art and to provide a perforating device that prevents dregs of melted thermoplastic film from getting stuck to the heating elements of the thermal head when a thermoplastic film is thermally perforated. Thus, the heating elements are kept clean to constantly perforate clear-cut character string patterns.

A perforating device is used by a stamp unit for perforating a desired character string pattern on the print face portion of the stamp unit that incorporates an ink impregnation member covered with heat sensitive stencil paper including a thermoplastic film. The perforating device includes a thermal head having a plurality of heating elements selectively heated to a first temperature to melt the thermoplastic film and perforate the heat sensitive stencil paper based on the character string pattern. The perforating device also includes a moving device for moving the thermal head and the print face portion relative to each other after the thermal head has performed the perforation and a head driving device for powering the heating elements to a second temperature lower than the first temperature while the thermal head and the print face portion are being moved relative to each other.

The first temperature is made higher than the melting temperature of the thermoplastic film while the second temperature is made lower than the melting temperature of the thermoplastic film.

Thus, when perforating the desired character string pattern on the print face portion of the stamp unit, the perforating device includes a plurality of heating elements selectively heated to reach the first temperature. The heating elements at the first temperature melt the thermoplastic film to form the character string pattern on the heat sensitive stencil paper. During the thermal perforation, the thermoplastic film is melted by the selectively activated heating elements. After the melting, the heating elements cool such that the melted thermoplastic film solidifies and attaches to the surface of the heating elements.

While the thermal head is performing thermal perforation, the thermal head and the print face portion move relative to each other using the moving device. During the relative movement, the heating elements of the thermal head are powered by the head driving device to the second temperature lower than the first temperature. The application of power softens the melted film residue stuck on the heating elements during perforation of the character string pattern. The relative motion of the thermal head and the print face portion causes friction of the attached film against the vicinities of the holes formed on the thermoplastic film. The friction removes the stuck film from the heating elements and leaves the removed dregs in the vicinities of the holes. This prevents the residual of melted thermoplastic film from sticking to the heating elements of the thermal head. The heating elements of the thermal head are therefore kept clean to ensure thermal perforation of unblurred character string patterns.

If the first temperature is made higher than the melting temperature of the thermoplastic film and if the second temperature is made lower than that melting temperature, the sticking of the melted film to the heating elements may be prevented more reliably and efficiently.

Other objects, advantages and salient features of the invention will become apparent from the detailed description taken in conjunction with the drawings.

BRIEF DESCRIPTION OF THE DRAWINGS

A preferred embodiment of the present invention will be described in detail with reference to the following figures wherein the reference numerals refer to like elements and wherein.

DETAILED DESCRIPTION OF PREFERRED EMBODIMENTS

Preferred embodiments according to this invention will be described with reference to the accompanying drawings.

Figure 9:
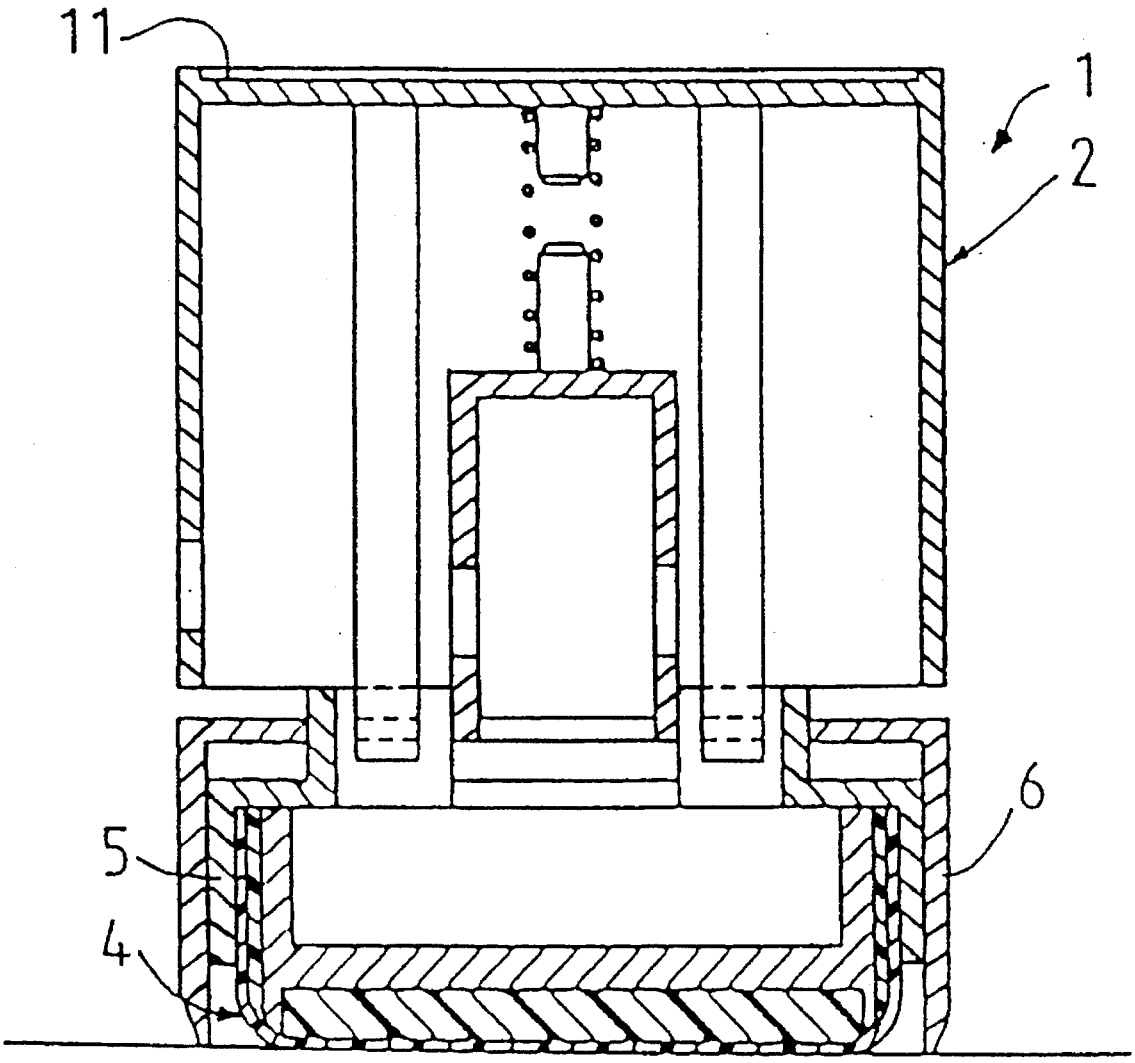
FIG. 9 is a longitudinally sectional front view of the stamp member showing the skirt member at another position.
Figure 10:
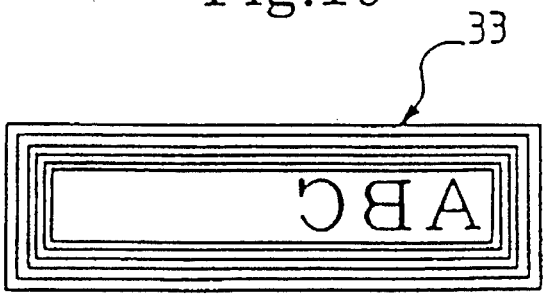
FIG. 10 is a diagram showing an example pattern to be formed.
Figure 11:
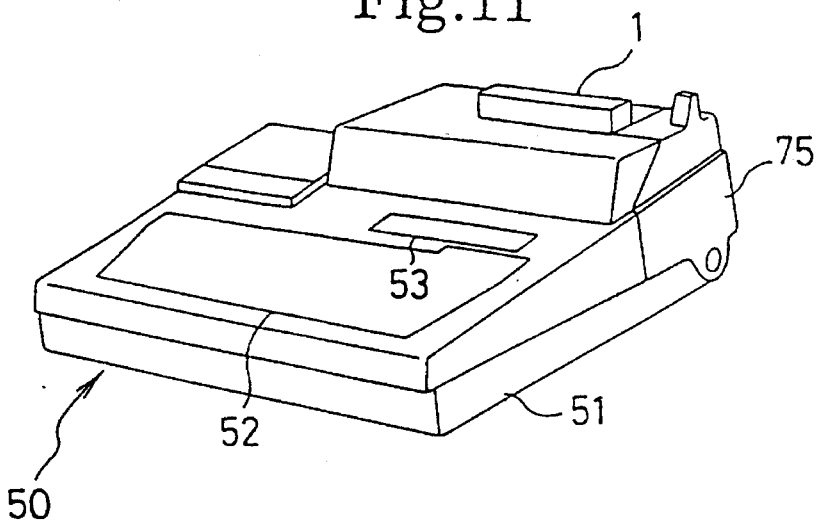
FIG. 11 is a perspective view of a thermal perforating device.
Figure 12:
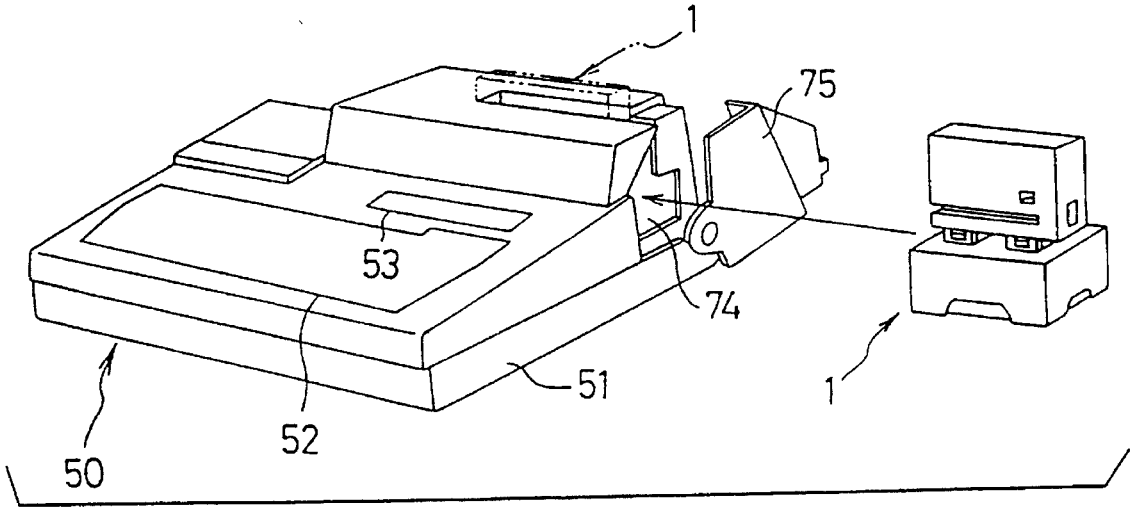
FIG. 12 is a perspective view of the thermal perforating device and the stamp member.

The stamp device of this embodiment comprises a stamp member 1 as shown in FIGS. 1 to 10 and a thermal perforating device 50 shown in FIG. 11 and subsequent figures. The stamp member 1 will first be described with reference to FIGS. 1 to 10.

As shown in FIGS. 1 to 4, the stamp member 1 includes a grip portion 2 that is grasped by a hand, a stamp unit 3 that is fixedly linked to the grip portion 2, a skirt member 6 covering the outer peripheral of the stamp unit 3 and a protection cap 7 that is detachably mounted on the stamp unit 3.

The grip portion 2 includes a hollow member having a rectangular parallelopiped shape and preferably formed of metal or synthetic resin material. The grip portion has an opened lower end.

A recess portion 11 having a label 10 is formed at a top portion of the grip portion 2. A pair of engaging pawls 14 (FIG. 2) project downwardly at each of the lower end portions of a front wall 12 and a rear wall 13 of the grip portion 2. A guide groove 15 is formed at each of the lower portions of the front wall 12 and the rear wall 13. An engaging recess 16 is formed on the front wall 12 and an engaging hole 18 is formed on the left side wall 17. A spring support portion 20 is formed at the central portion of the lower surface of the upper wall 19 inside of the grip portion 2.

The stamp unit 3 includes a stamp unit body 4 and an outer-periphery holding member 5 into which the stamp body 4 is fixedly inserted from the lower side, and which covers about a ⅔ portion of the upper portion at the outer peripheral of the stamp unit body 4. The holding member 5 engages with the four engaging pawls 14 of the grip portion 2.

Figure 3:
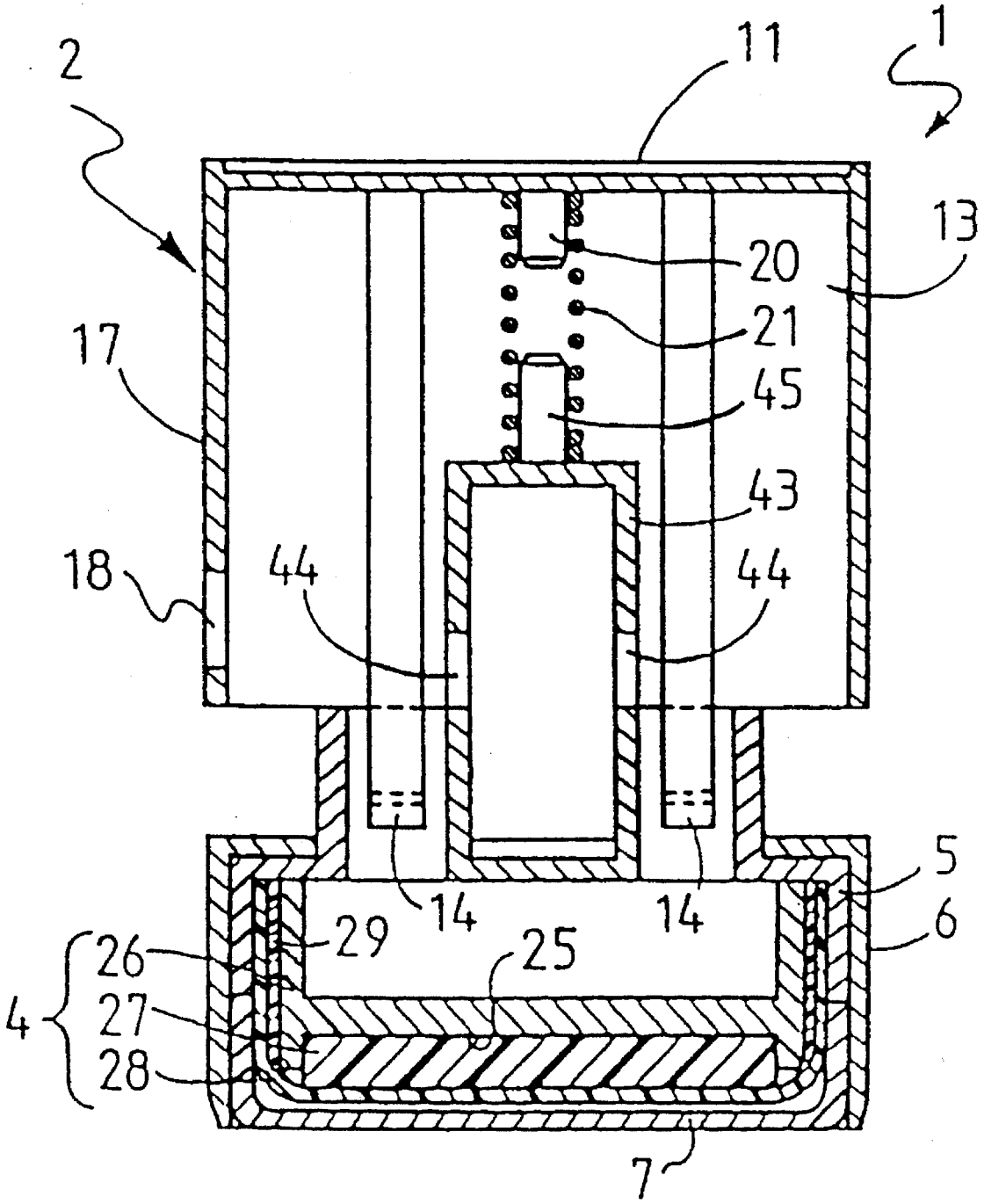
FIG. 3 is a longitudinally sectional front view of the stamp member.
Figure 4:
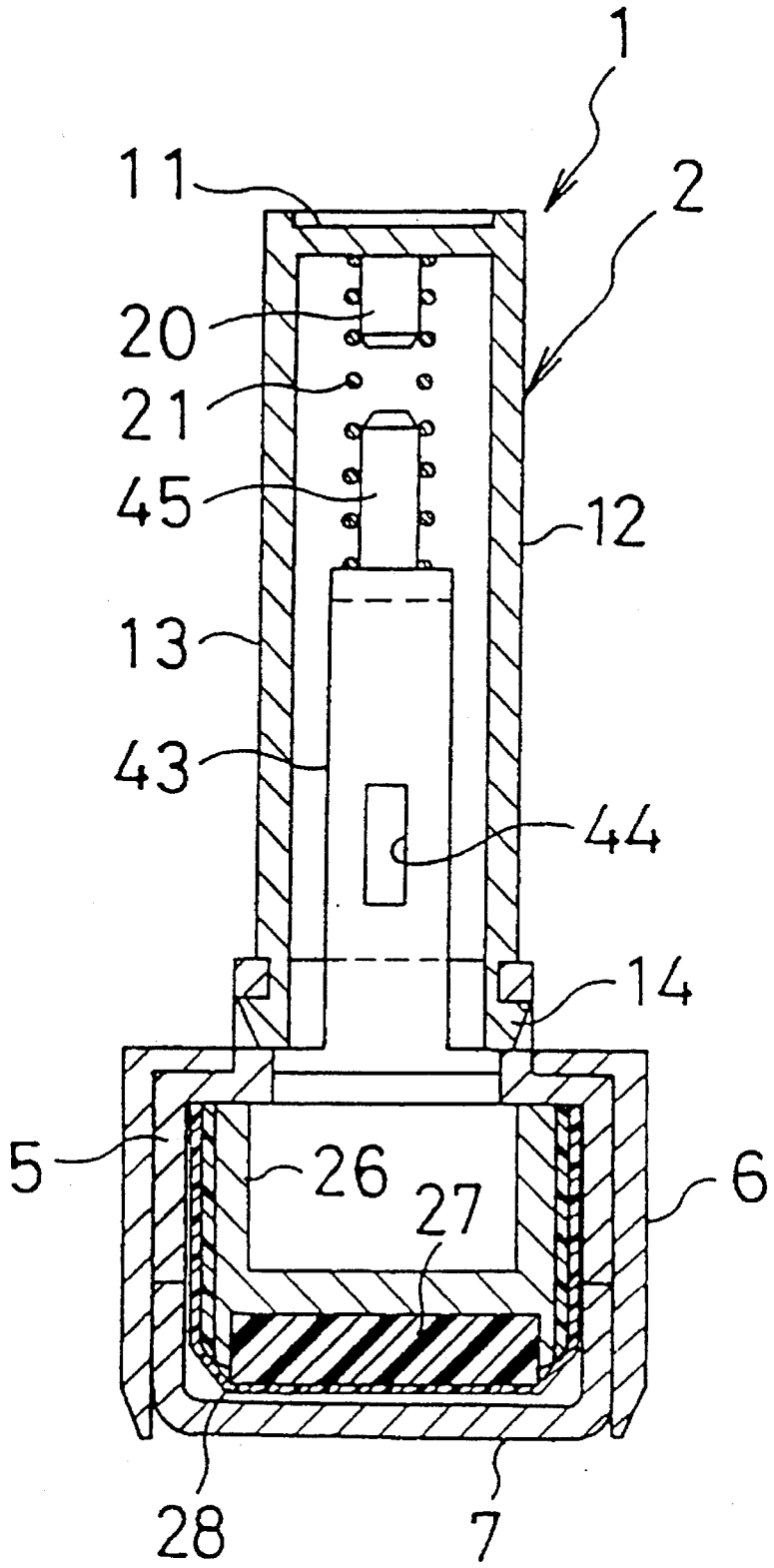
FIG. 4 is a longitudinally sectional side view of the stamp member.

As best shown in FIGS. 3 and 4, the stamp unit body 4 includes a base member 26 of synthetic resin that is designed in a rectangular parallelopiped shape having a hollow body and provided with a shallow recess portion 25 at the lower surface. An impregnation member 27 (i.e., an ink member) is mounted on the recess portion 25 and is impregnated with oil ink. A heat sensitive stencil paper 28 covers the lower surface of the impregnation member 27 and the outer peripheral side of the base member 26. The heat sensitive stencil paper 28 is adhesively attached to the outer peripheral surface of the base member 26 using an adhesive agent 29 as shown in FIG. 3. The impregnation member 27 may also be adhesively attached to the recess portion 25 using an adhesive agent.

The base member 26 is preferably formed of a synthetic resin material having excellent oil-proof properties (e.g., vinyl chloride, polypropylene, polyethylene, polyacetal or polyethylene terephthalate) or a metal material because it contacts the oil ink. The impregnation member 27 is mounted on the recess portion 25 to prevent positional deviation of the impregnation member 27 and to prevent the flow of ink out from the impregnation member 27.

The impregnation member 27 includes an elastic foaming member that is formed of a synthetic material (e.g., polyethylene, polypropylene, polyethylene terephthalate, polyurethane or acrylonitrile-butadiene rubber) or a non-woven fabric. The impregnation member 27 is impregnated with ink in a saturation state. Thus, by pressing the impregnation member 27, the ink oozes out from the impregnation member 27.

Figure 6:
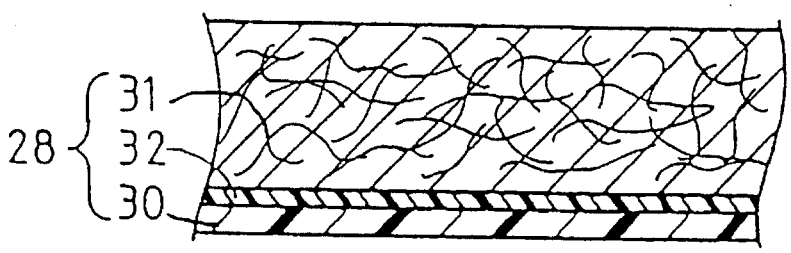
FIG. 6 is an enlarged cross-sectional view of a heat sensitive stencil paper of the stamp member.

As shown in FIG. 6, the heat sensitive stencil paper 28 includes a thermoplastic film 30, a porous carrier 31 and an adhesive layer 32 to adhesively attach the thermoplastic film 30 to the porous carrier 31. The thermoplastic film 30 is formed of a thermoplastic synthetic resin film (e.g., polyethylene terephthalate, polypropylene or vinylidene chloride-vinyl chloride copolymer) of 1 to 4 μm thickness and preferably 2 μm thickness.

If the thickness is less than 1 μm, the manufacturing cost becomes high and its strength becomes low. On the other hand, if the thickness is above 4 μm, the film 30 is too thick to perforate the film with a general thermal head having a rated power of about 50 $mJ/mm^2$.

The porous carrier 31 is formed of a porous thin sheet of paper made primarily of a natural fiber (such as Manila hemp, kozo or mitsumata), a synthetic fiber (such as polyethylene terephthalate, polyvinyl alcohol or polyacrylonitrile) or a semi-synthetic fiber (such as rayon).

Figure 5:
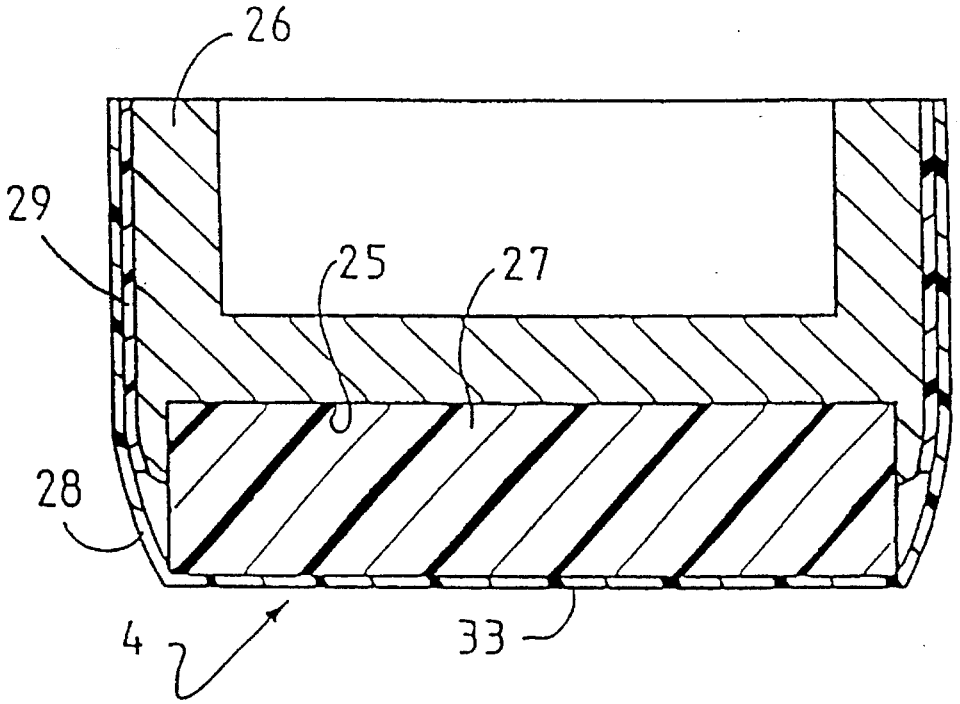
FIG. 5 is an enlarged longitudinally sectional front view of a stamp unit body of the stamp member.
Figure 7:
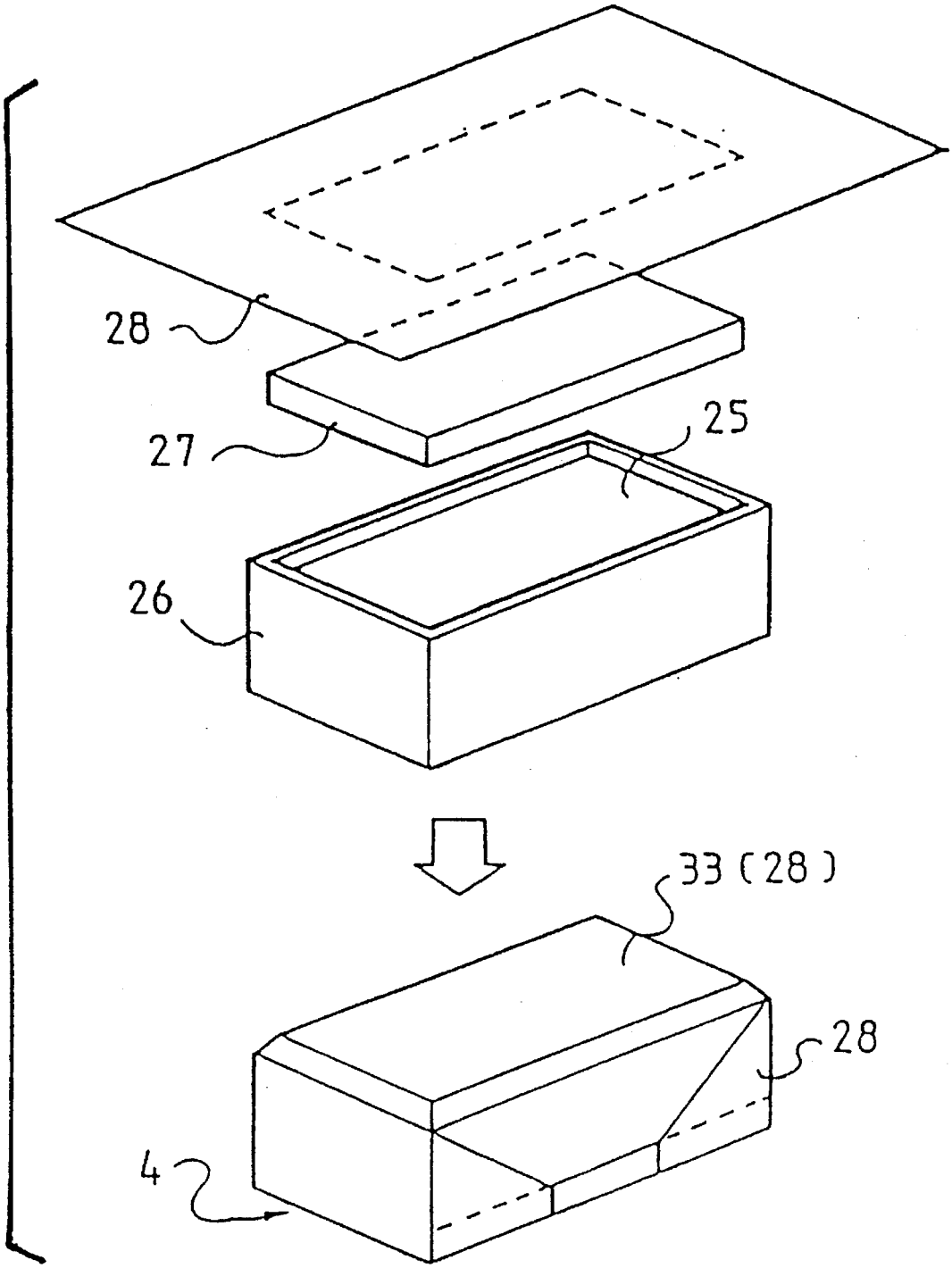
FIG. 7 shows a manufacturing method of the stamp unit body.

As shown in FIGS. 5 and 7 where the base member 26 is inverted, the impregnation member 27 is mounted on the recess portion 25 and is then impregnated with ink. Thereafter, the impregnation member 27 is covered with the heat sensitive stencil paper 28 so that the porous carrier 31 faces the impregnation member 27 and the heat sensitive stencil paper 28 closely contacts the impregnation member 27. The outer-peripheral of the heat sensitive stencil paper 28 is folded to come into close contact with the outer peripheral surface of the base member 26 and is adhesively attached thereto using an adhesive layer 29 as shown in FIG. 7.

A portion of the heat sensitive stencil paper 28 that is closely contacted with the surface (lower surface in FIG. 5) of the impregnation member 27 serves as the print face portion 33. As described above, since the structure in which the outer peripheral side of the heat sensitive stencil paper 28 is contacted with the outer peripheral surface of the base member 26, the print face portion 33 can be formed over substantially the whole area of the lower surface of the stamp member 3 so that positioning can be simplified.

In order to adhesively attach the outer peripheral side portion of the heat sensitive stencil paper 28 to the outer peripheral surface of the base member 26, the adhesive layer 29 may be formed beforehand at the outer peripheral side portion of the heat sensitive stencil paper 28. Additionally, the adhesive layer 29 may be formed on the outer peripheral surface of the base member 26 or the adhesive layer 29 may be formed at the outer peripheral side portion of the heat sensitive stencil paper 28 and on the outer peripheral surface of the base member 26.

Figure 1:
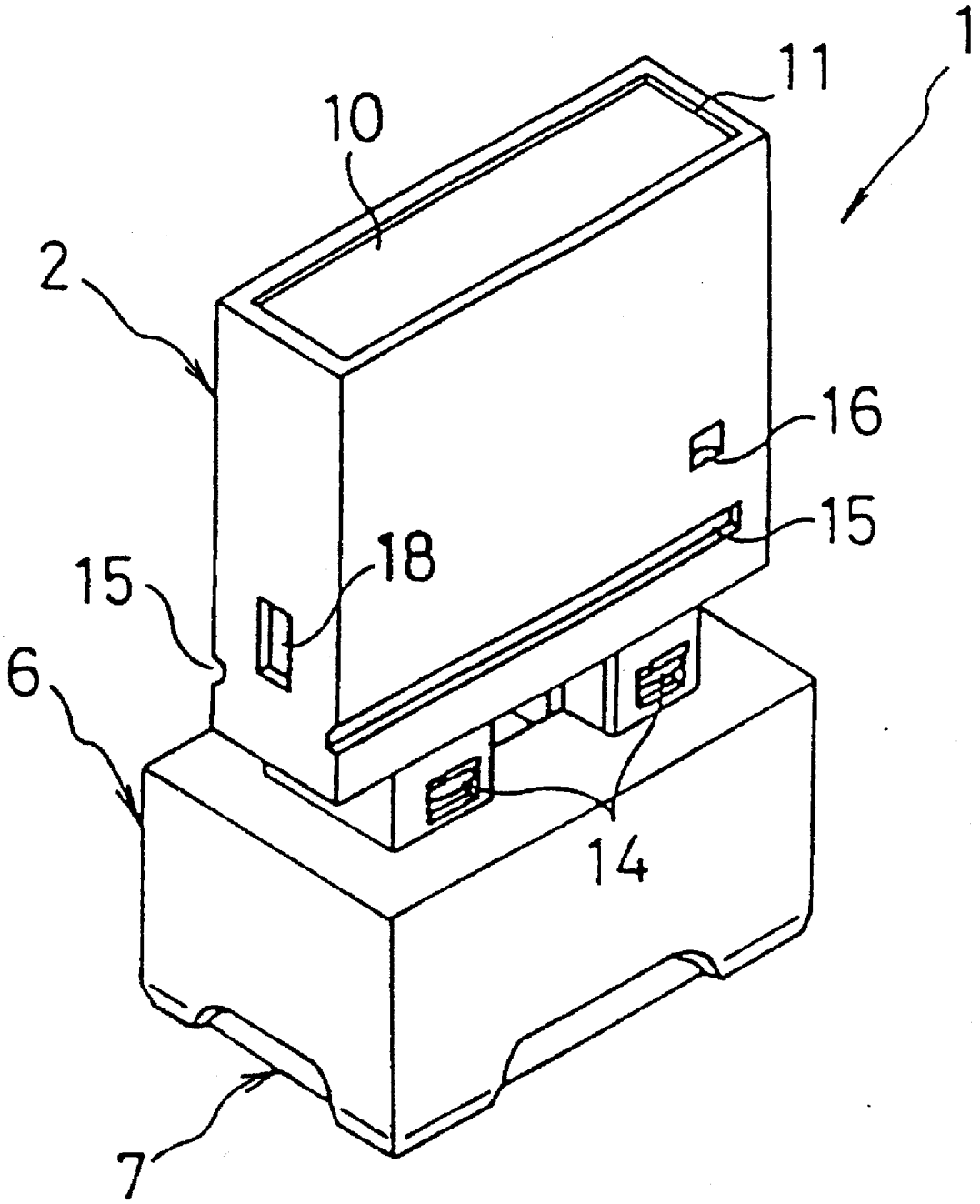
FIG. 1 is a perspective view of a stamp member for a stamp device according to an embodiment of the invention.
Figure 2:
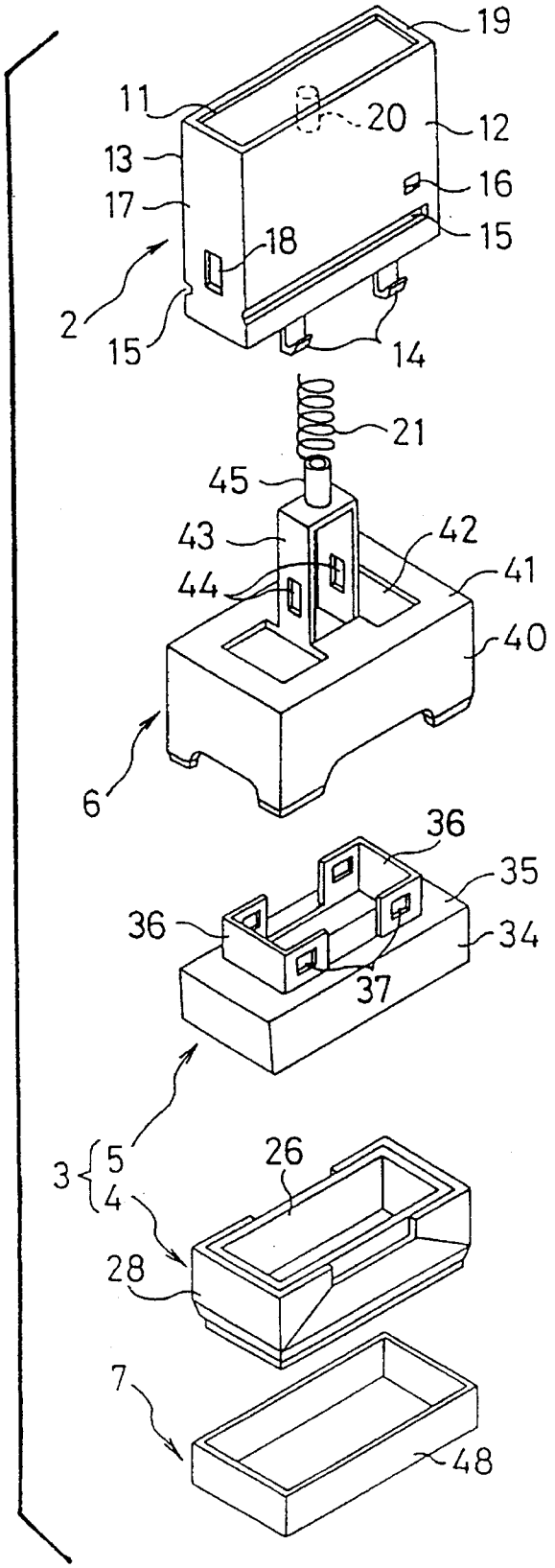
FIG. 2 is an exploded perspective view of the stamp member.

As shown in FIGS. 2 to 4, the outer-periphery holding member 5 includes a peripheral wall portion 34 having a rectangular section that is adhesively attached to the stamp unit body 4 when the stamp body 4 is inserted inside of the peripheral wall portion 34. The outer-periphery holding member 5 also includes an upper wall portion 35 and a pair of right and left engaging wall portions 36 that project a predetermined height from the upper wall portion 35. Engaging holes 37 correspond to the four engaging pawls 14 of the grip portion 2 and are formed on the right and left engaging wall portions 36. The right and left engaging wall portions 36 are slidably inserted into the right and left rectangular holes on the upper wall 41 of the skirt member 6 from the lower side. The four engaging pawls 14 engage with the four engaging holes 37 of the engaging wall portions 36 from the upper side and the upper ends of the engaging wall portions 36 contact the lower end of the grip portion 2 to fix the outer-periphery holding member 5 to the grip portion 2.

As shown in FIGS. 2 to 4, the skirt member 6 includes an outer-peripheral wall portion 40 having a rectangular section into which the outer-peripheral wall portion 34 of the outer-periphery holding member 5 is slidably inserted. An upper wall portion 41 is located at the upper end of the outer peripheral wall portion 40 and at the upper side of the upper wall portion 35 of the outer-periphery holding member 5. A portal portion 43 projects upwardly from the central portion of the upper wall portion 41 by a predetermined height and inserts into the grip portion 2. A spring support portion 45 is projectingly provided at the upper central portion of the portal portion 43.

At the lower portion of the right and left wall portions of the portal portion 43, guide holes 44 are formed at the front and rear side corresponding to the guide holes 18 so as to be penetrated through both of the wall portions.

A compress spring 21 urges the skirt member 6 downwardly with respect to the grip portion 2 and is mounted on the spring support portion 20 and the spring support portion 45. The skirt member 6 is designed to be freely moved upwardly and downwardly among a first position shown in FIGS. 3 and 4, a second position shown in FIG. 9 and a third position shown in FIG. 8. The skirt member 6 is urged toward the first position by the spring 21. The lower end portions on the four surfaces of the outer peripheral wall 40 are partially cut so that the protection cap 7 may be detached to position the print face portion 33.

At the first position shown in FIGS. 3 and 4, the upper wall portion 41 of the skirt member 6 abuts against the upper wall portion 35 of the holding member 5 and the lower end of the skirt member 6 projects below the print face portion 33. At the second position shown in FIG. 9, the upper wall portion 41 is located between the upper wall portion 35 of the holding member 5 and the lower end of the grip portion 2. The lower end of the skirt member 6 is located at the same level as the print face portion 33. At the third position, the upper wall portion 41 abuts against the lower end of the grip portion 2 and the lower end of the skirt member 6 is higher than the print face portion 33. A stroke of the skirt member 6 from the first position to the second position is preferably about 5 mm.

The protection cap 7 is detachable and covers the lower end side of the stamp unit body 4 to protect the stamp unit body. The outer wall portion 48 is designed in the same shape as the outer peripheral wall 34 of the holding member 5. The protection cap 7 is inserted into the inner portion of the outer peripheral wall portion 40 of the skirt member 6 and is supported thereby.

As shown in FIGS. 3 and 4, in a state where the protection cap is mounted, the upper end abuts against the lower end of the outer peripheral wall 34 and a small gap occurs between the protection cap 7 and the print face portion 33. The protection cap 7 is preferably supported by a frictional force between the outer peripheral surface of the outer peripheral wall portion 48 and the inner peripheral surface of the outer peripheral wall portion 40 of the skirt member 6. Therefore, even when the grip portion 2 is downwardly pressed when the protection cap 7 is mounted, the gap is maintained due to the abutment between the upper end of the protection cap 7 and the lower end of the outer peripheral wall 34. Thus, no ink adheres to the protection cap 7.

For example, as shown in FIG. 10, many pores (dot-pattern pores) of a pattern of a character array of a mirror letter of "BROTHER KOGYO KABUSHIKI KAISHA" and sextuple rectangular frames surrounding the outer side of the character array are formed by a thermal head of a thermal printer (not shown) on the print face portion to form a stamp member capable of printing a character array of a mirror image of the pattern of FIG. 10. Accordingly, like an ordinary stamp having a print face portion formed of rubber, the pattern as described above can be repeatedly printed over 1000 times, for example. Further, the perforation may be performed by irradiation of infrared rays in place of the thermal head.

When the heat sensitive stencil paper 28 serving as the print face portion 33 is perforated, the stamp member 1 is mounted on the perforation mount portion 71 of the thermal perforating device 50 as described below. A guide bar 83 is inserted through guide holes 18, 44, 44 to keep the skirt member 6 at the third position so that perforation is allowed. When the device is unused, the protection cap 7 is mounted and the skirt member 6 is kept at the first position as shown in FIGS. 3 and 4. When a print is performed, the protection cap 7 is detached and the skirt member 6 is maintained at the first position to position the skirt member 6 in a printing position on the surface of a sheet to position the print face portion 33 of the stamp unit 3. Thereafter, the grip portion 2 is downwardly pressed to perform the print as shown in FIG. 9.

The thermal perforating device 50 will now be described in detail. As shown in FIGS. 11 to 15, the thermal perforating device 50 includes a body frame 51, a keyboard 52 and a liquid crystal display 53 provided at the front portion of the body frame 51. A thermal perforating unit 54 is provided at the rear portion of the main frame 51 and a control unit 55 is provided inside of the body frame 51.

The keyboard 52 includes character and symbol keys 56, which are used as both a Japanese Kana key and an alphabet key. The keyboard 52 also includes various function keys such as cursor moving keys 57, an execution key 58, a line feed key 59, a determine/end key 60, a cancel key 61, a delete key 62, a shift key 63, a small-letter key 64, a letter kind setting key 65, a perforation switch 66 and a main switch 67.

The liquid crystal display device 53 is designed to display several lines of character arrays corresponding to a pattern to be printed by the stamp member 1.

The thermal perforating unit 54 will now be described. As shown in FIGS. 13 to 22, the thermal perforating unit 54 includes a perforation mount 71 on which the stamp member I is detachably mounted and a thermal perforating mechanism 72 for perforating the print face portion 33 of the stamp member 1 mounted on the perforation mount 71.

As shown in FIGS. 14 to 17, a right side wall 73 of a subframe 70 is formed with an opening 74 having substantially the same shape as the side surface of the lower half of the stamp member 1 and having the longest width in a front and rear direction of the stamp unit 3. A sector gear 76 is provided with a door 75 for opening and closing the opening 74. The door 75 and the sector gear 76 are freely pivoted on the right side wall 73 by a pivot shaft 77. The upper portion of the subframe 70 is provided with a pair of parallel guide members 78 and 79 at the front and rear sides thereof. The lower ends of the guide members 78 and 79 include guide portions 80 that extend horizontally in parallel to each other so as to face each other.

Figure 15:
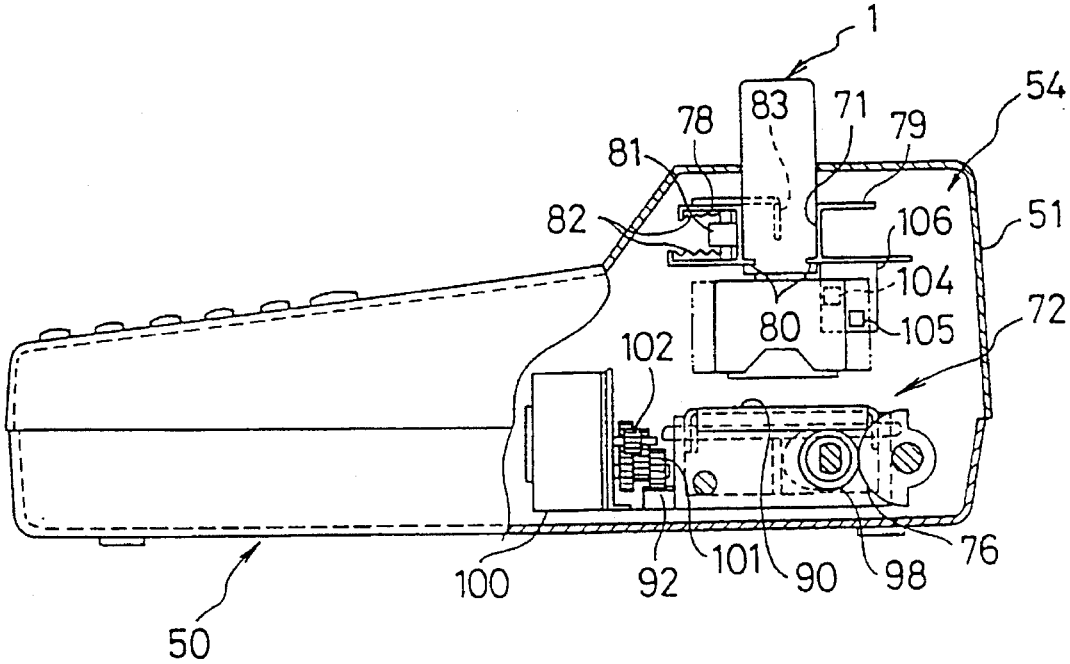
FIG. 15 is a longitudinally sectional side view of the thermal perforating device.
Figure 16:
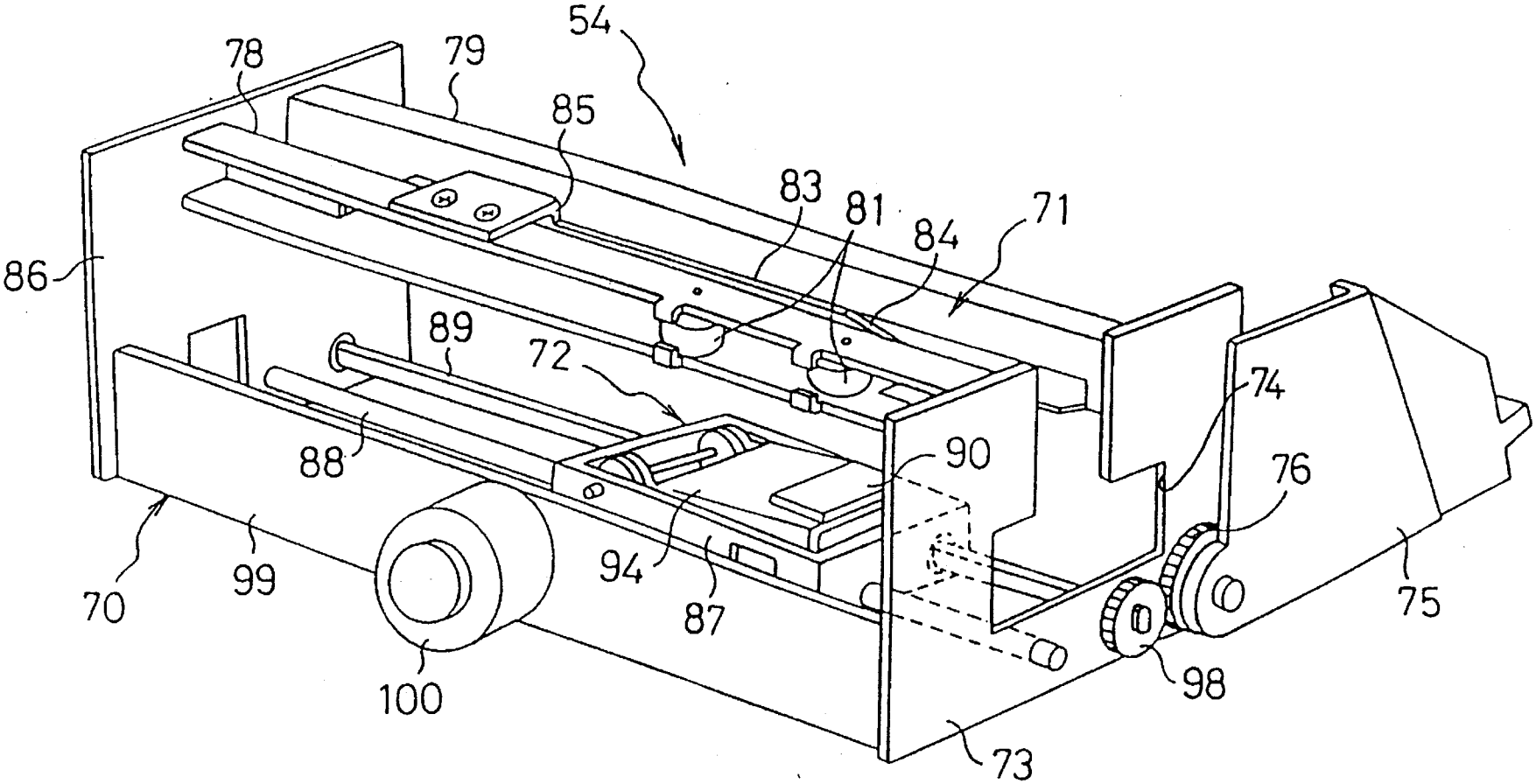
FIG. 16 is a perspective view showing a thermal perforating unit.
Figure 17:
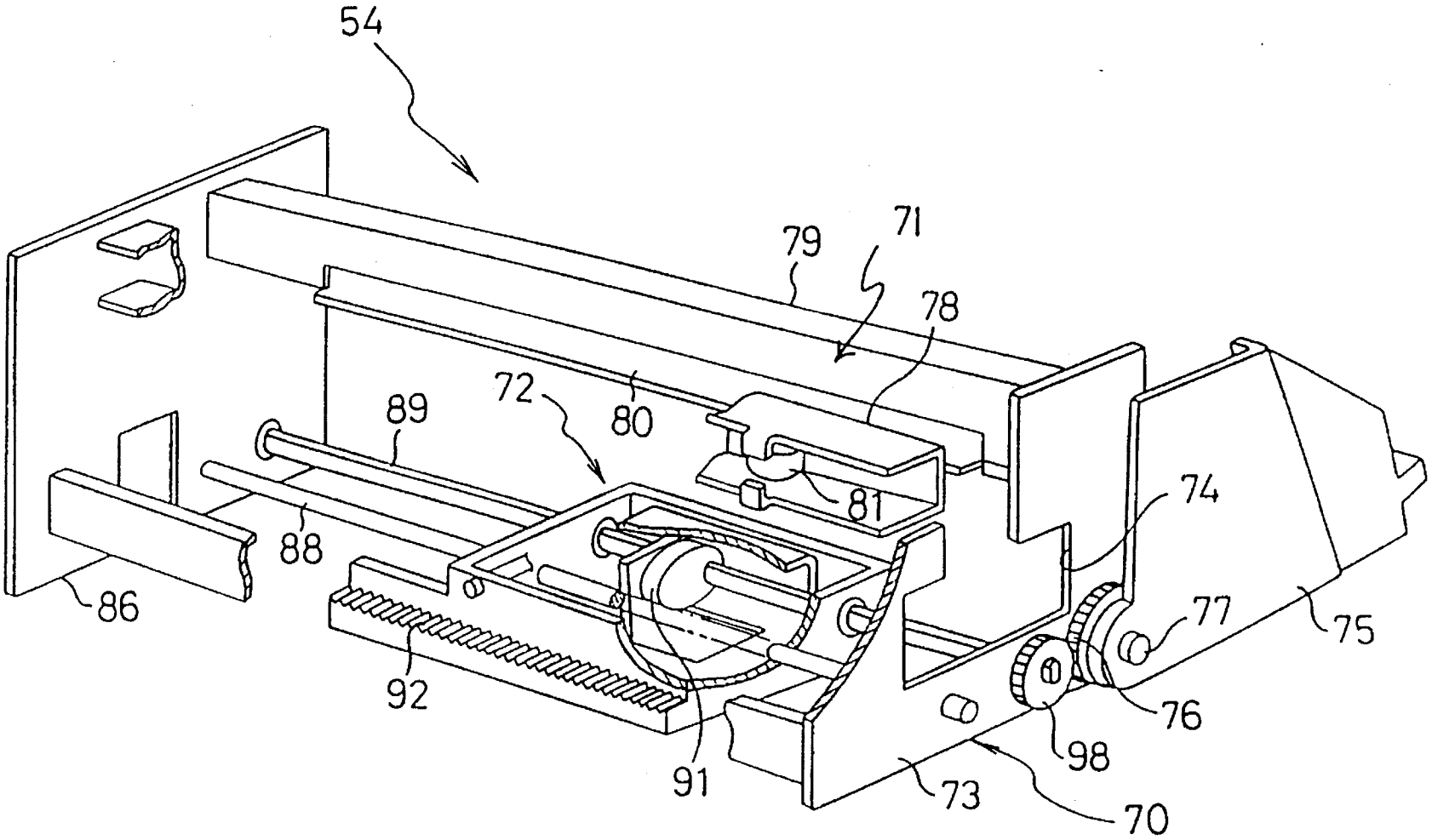
FIG. 17 is a perspective view of the thermal perforating unit.

A pair of right and left rollers 81 are provided to the guide member 78 at the front side through an elongated hole so as to be movable in the front and rear direction of FIG. 16 by a short distance. These rollers 81 are urged rearwardly by a spring 82 as shown in FIG. 15.

Figure 20:
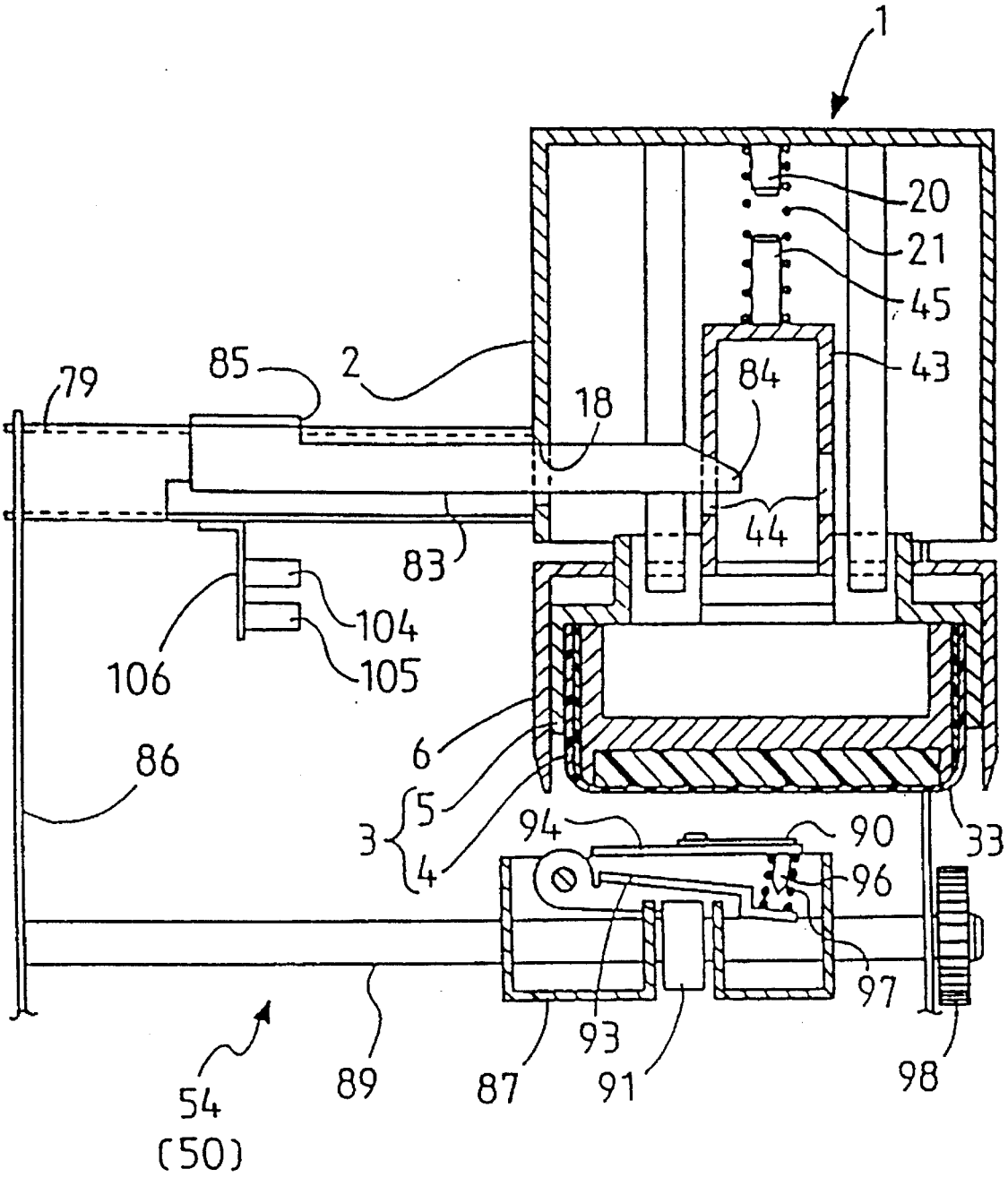
FIG. 20 is a longitudinally sectional front view of the stamp member mounted on the perforation mount and the thermal perforating unit.
Figure 21:
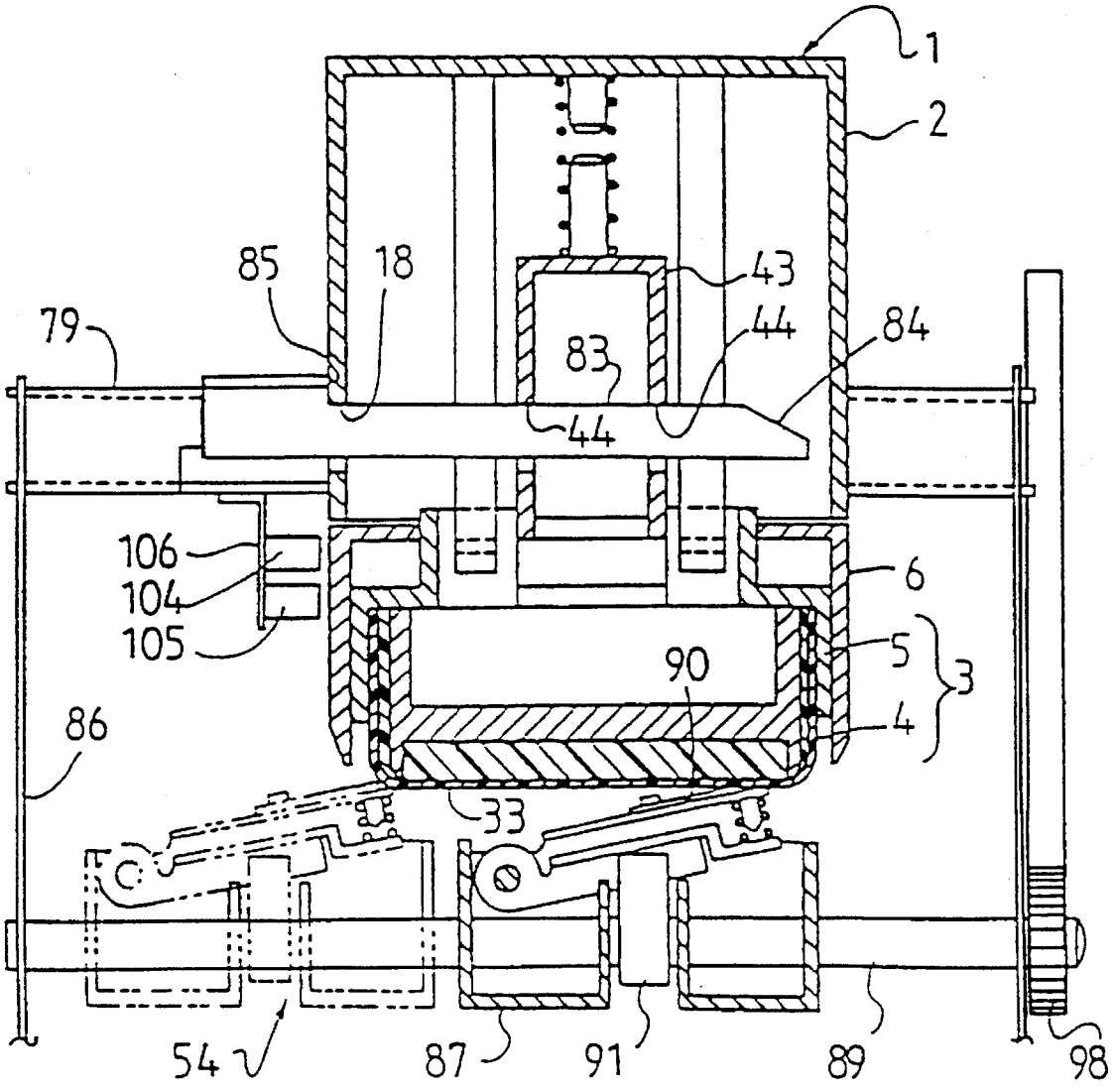
FIG. 21 is a longitudinally sectional front view of the stamp member mounted on the perforation mount and the thermal perforating unit.

The guide bar 83 fixed to the guide member 78 at the front side is disposed at a middle position between the guide members 78 and 79. A papered face 84 inclines in a lower right direction is on the upper surface of the right end of the guide bar 83 as shown in FIGS. 16 and 20. An engaging portion. 85 for defining the left position of the stamp member 1 is formed at the left end of the guide bar 83.

The stamp member 1 is inserted through the opening 74 such that the guide members 80 engage with the grooves 15 of the grip portion 2. Thus, the stamp member 1 is supported by the guide members 80 and is urged rearwardly by the rollers 81 and spring 82. Further, the position of the stamp member 1 can be accurately set in the right and left direction when the stamp member 1 abuts against the engaging portion 85 and the roller 81 on the right side engages with the engaging recess portion 16 of the grip portion 2.

Figure 8:
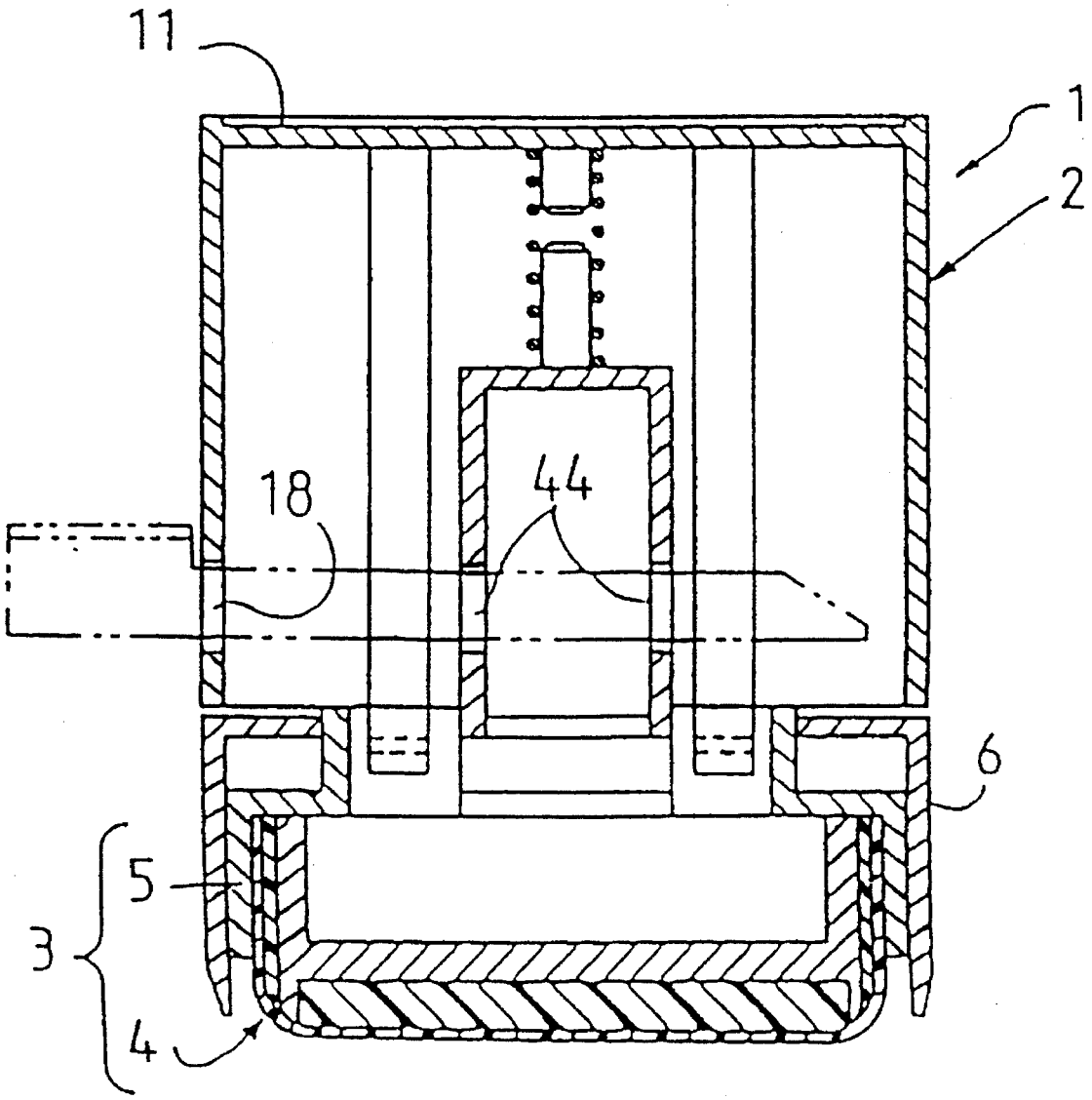
FIG. 8 is a longitudinally sectional front view of the stamp member showing the skirt member at one position.

When the stamp member 1 is mounted on the perforation mount 71, the guide bar 83 is inserted through the guide holes 18, 44, 44 of the stamp member 1 to move the skirt member 6 upwardly and maintain the third position as shown in FIG. 8.

The thermal perforating mechanism 72 will now be described. As shown in FIGS. 13 to 22, the lower side of the perforation mount 71 includes a guide rod 88 extending in the right and left direction to guide a carriage 87. A head switching rod 89 also extends in the right and left direction and operates a cam member 91 for switching the position of the thermal head 90 mounted on the carriage 87. The guide rod 88 and head switching rod 89 are suspended between the right end wall 73 and the left end wall 86 of the subframe 70. The cam member 91 is mounted on the head switching rod 89 so as not to be rotatable and to be freely slidable in the axial direction.

The carriage 87 is supported on the guide rod 88 and the head switching rod 89 to be freely movable in the right and left directions. A rack 92 is formed at the front end of the carriage 87 having a length at least the length of the carriage 87.

A cam contact plate 93 and a head heat-radiating plate 94 are mounted on the carriage 87 by a shaft 95 extending in the front and rear directions so that the plates 93 and 94 are freely slidable in the up and down directions. The thermal head 90 is fixed to the head heat-radiating plate 94 that is elastically urged upwardly relatively to the cam contact plate 93 by a spring 97 wound around a pin 96 fixed to the head heat-radiating plate 94. The cam member 91 is designed in an elliptic shape to contact the lower surface of the cam contact plate 93. When the cam member 91 is laterally oriented by rotating the head switching rod 89, the thermal head 90 is downwardly released together with the head heat-radiating plate 94. When the cam member 91 is erectly oriented, the thermal head 90 is swung upwardly by the cam contact plate 93 and the spring 97 and is switched to a perforation position.

Figure 18A:
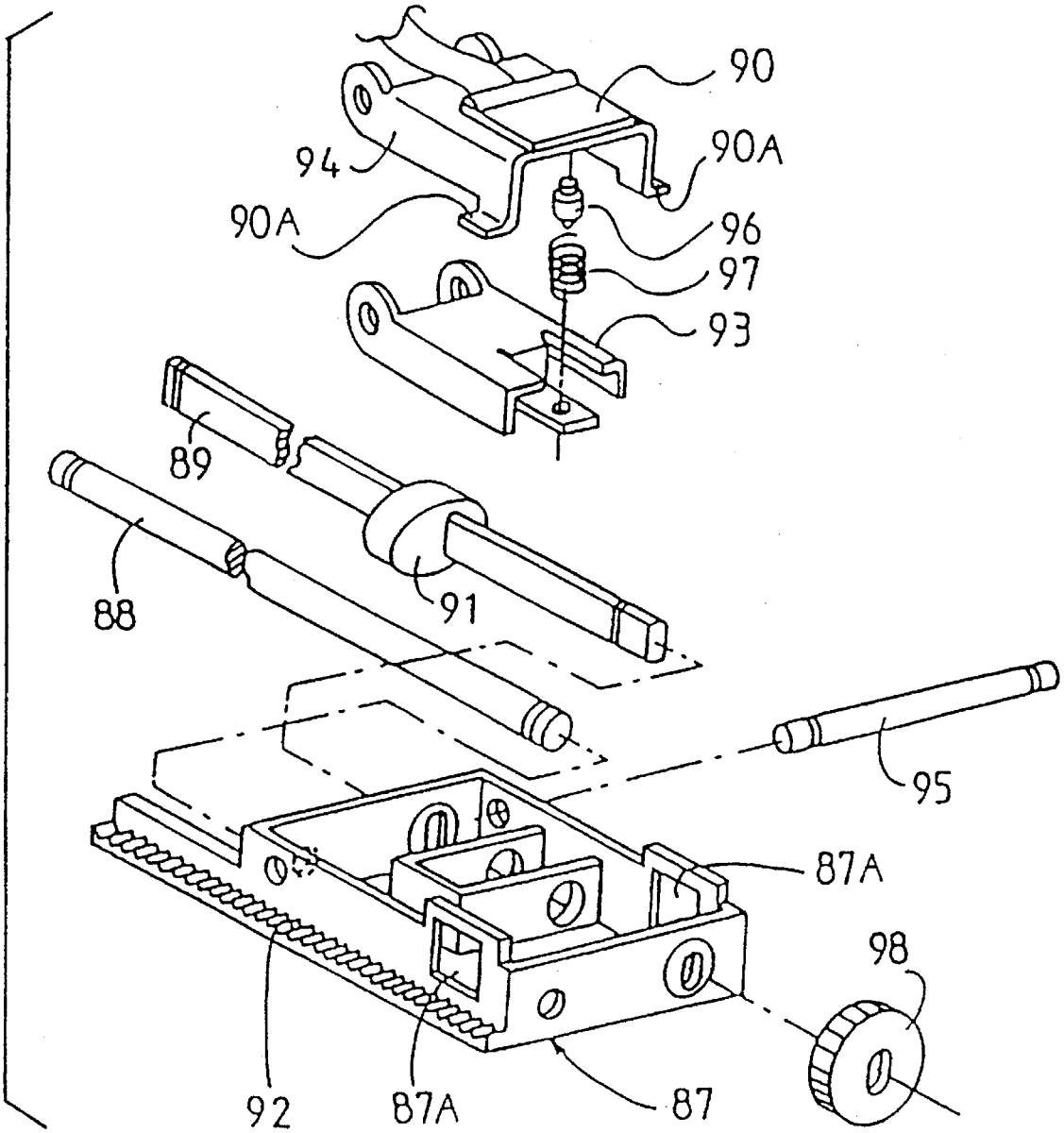
FIG. 18A is an exploded perspective view of the thermal perforating mechanism.
Figure 18B:
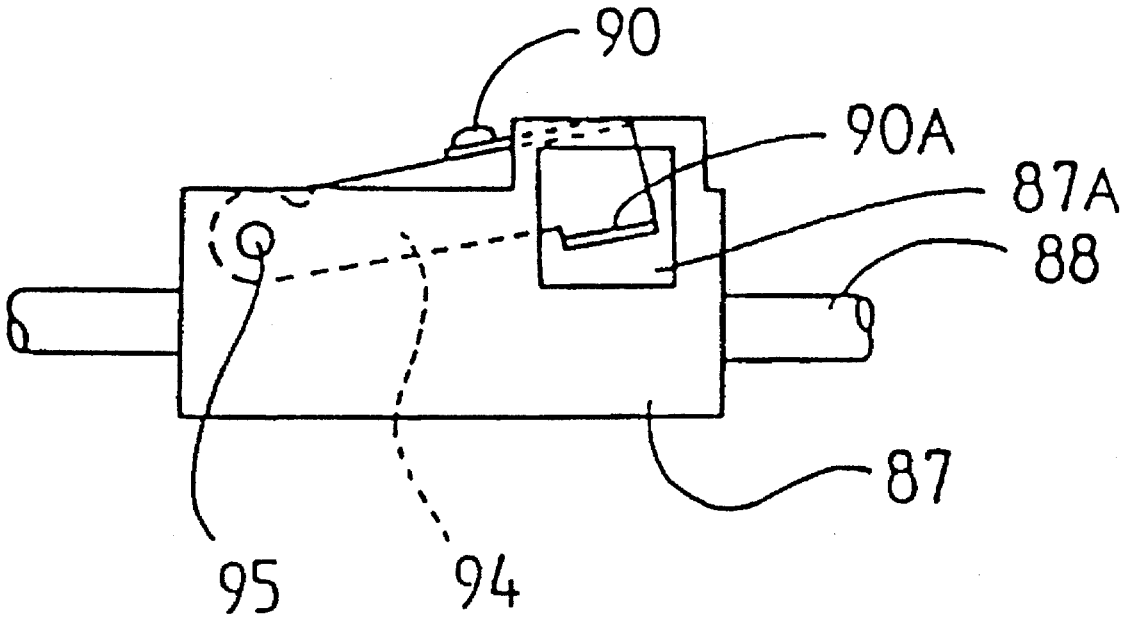
FIG. 18B is a front view of the thermal perforating mechanism shown in FIG. 18A.

In that perforation position, as shown in FIG. 18B, each engaging plate 90A of the head heat-radiating plate 94 is disengaged from the engaging holes 87A of the carriage 87. Thus the thermal head 90 is elastically urged upward with the head heat-radiating plate 94 by only the spring 97 with its predetermined actuating force (elastic resilience). In this state, the thermal head 90 compresses the print face portion 33 with a large pressing force and is unaffected by the elastic resilience of the impregnation member 27. If the impregnation member 27 is 3 mm thick, the elastic resilience of the spring 97 should preferably be such that the amount of compression of the impregnation member 27 will be approximately between 0.1 mm and 0.9 mm. With these settings, the thermal head 90 squeezes the impregnation member 27 by use of the spring 97 so that the amount of compression of the impregnation member 27 in the stamp unit 1 always falls within a predetermined range.

At the left end portion of the head switching rod 89, a gear 98 engages with the sector gear 76 at the outside of the right end wall 73. When the door 75 is opened, the cam member 91 is laterally oriented. On the other hand, when the door 75 is closed, the cam member 91 switches to a erect orientation.

A stepping motor 100 is provided on the front wall 99 of the subframe 70 for driving the carriage 87. A driving gear 101 engages with the rack 92. A decelerating mechanism transfers the rotation of an output gear 102 of an output shaft of the stepping motor 100 to the driving gear 101. Therefore, the rotational driving force of the stepping motor 100 is transferred to the driving gear 101 while being decelerated. Thus, the carriage 87 can be driven by the stepping motor 100 in both the right and left directions.

The thermal head 90 is the same as a thermal head of a thermal printer. That is, the thermal head 90 is provided with heating elements 96 arranged in a row in both the front and rear directions.

A control system having a control unit 110 for controlling the thermal perforating mechanism 72 and the liquid crystal display 53 will now be described.

Figure 22:
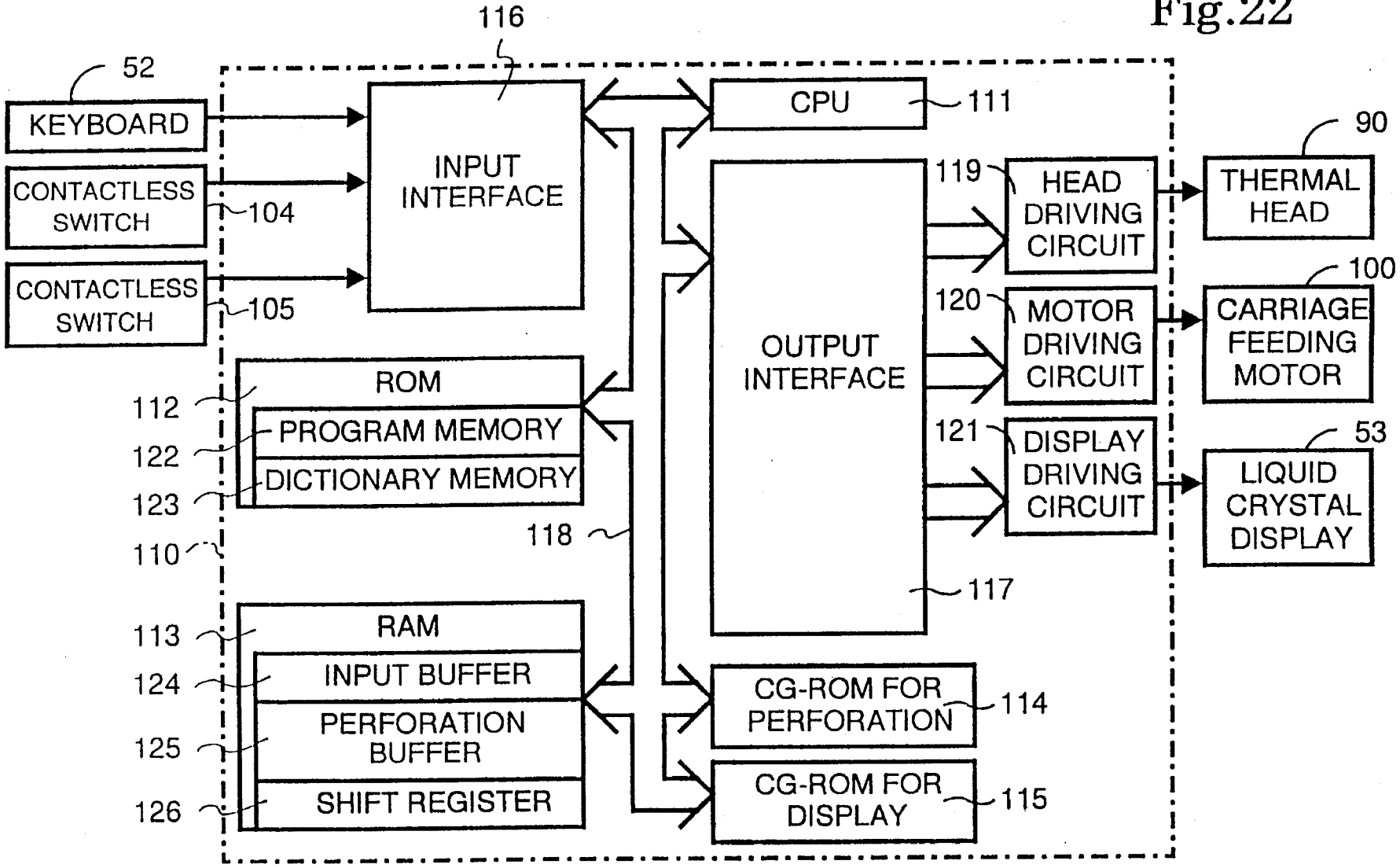
FIG. 22 is a block diagram showing a control system of the stamp device.

As shown in FIG. 22, the control unit 110 is connected to the keyboard 52, the thermal head 90, the carriage feeding motor 100, the liquid crystal display 53, and two contactless switches 104, 105 that detect presence of the stamp member 1 as well as width in the front and rear directions.

Figure 13:
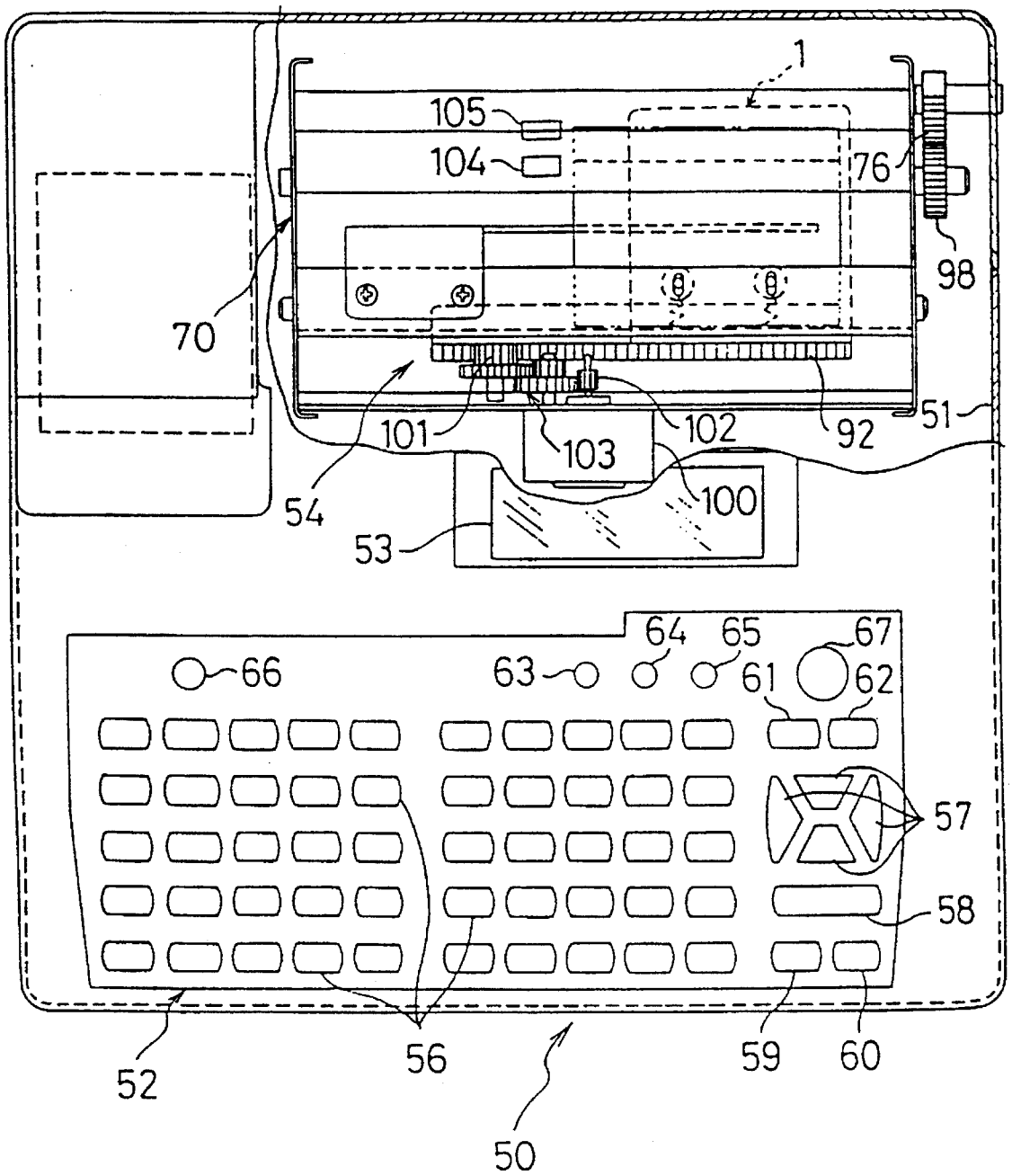
FIG. 13 is a view of the thermal perforating device.
Figure 14:
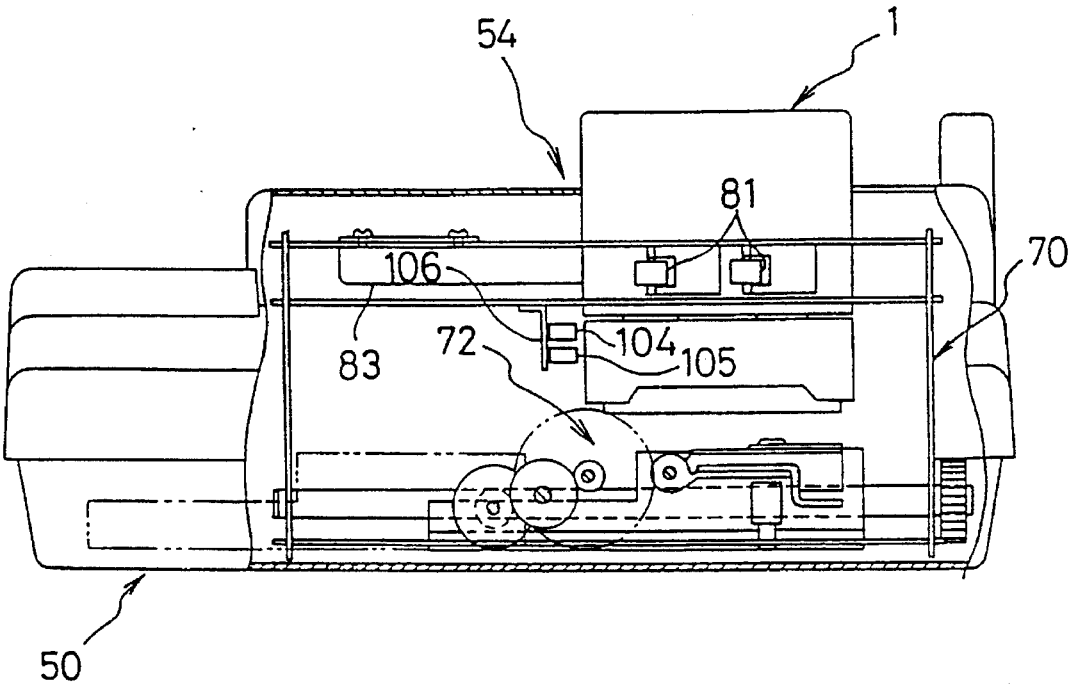
FIG. 14 is a front view of the thermal perforating device.
Figure 19:
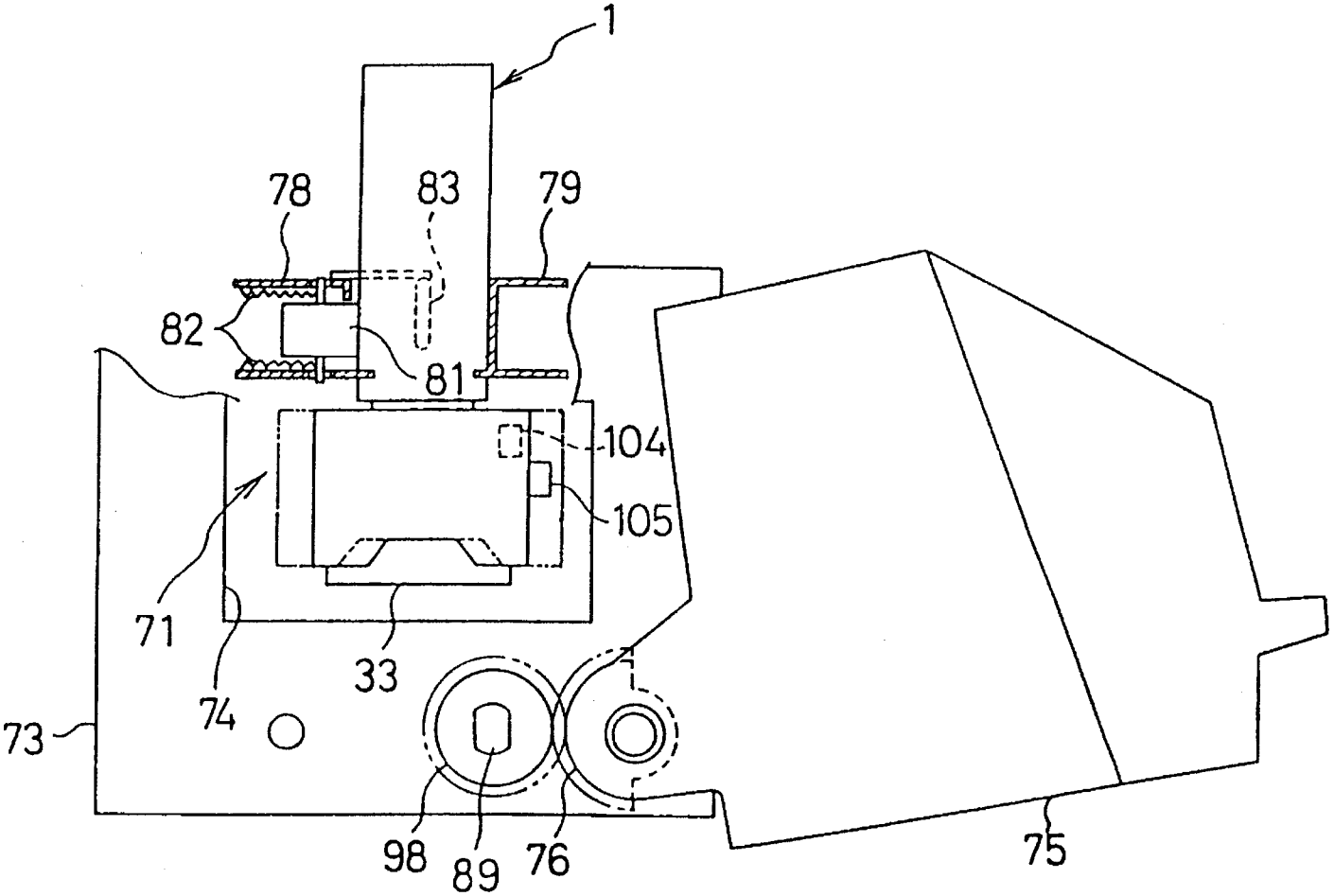
FIG. 19 is a side view of the thermal perforating unit.

In this embodiment, the stamp member 1 may be a narrow-width type as shown by the solid lines of FIGS. 15 and 19 or a wide-width type as shown by a chain line. The two contactless switches 104 and 105 are provided to a plate piece 106 fixed to the lower surface of the guide member 79 at the rear side as shown in FIGS. 13, 15 and 19. The wide-width stamp member 1 is detected by the contactless switches 104 and 105 while the narrow-width stamp member 1 is detected by the contactless switch 104.

As shown in FIG. 22, the control unit 110 includes a CPU 111, a ROM 112, a RAM 113, a perforation CG-ROM 114, a display CG-ROM 115 for display on the display 53, an input interface 116 connected to the keyboard 52 and the contactless switches 104 and 105, and an output interface 117. These elements may be connected to one another by a bus 118. The control unit 110 further includes a head driving circuit 119, a motor driving circuit 120 and a display driving circuit 121 connected to the output interface 117.

The ROM 112 includes a program memory 122 storing a control program for controlling the thermal perforating device 50 and a dictionary memory 123 for Kana/Kanji conversion.

The RAM 113 includes an input buffer 124 for storing input data, a perforation buffer 125 for storing perforation data, a shift register 126 as well as other various counters and registers. The perforation CG-ROM 114 includes dot pattern data of many character dots based on code data. The display CG-ROM 115 includes display dot pattern data of many characters serving as a perforation target.

Figure 23:
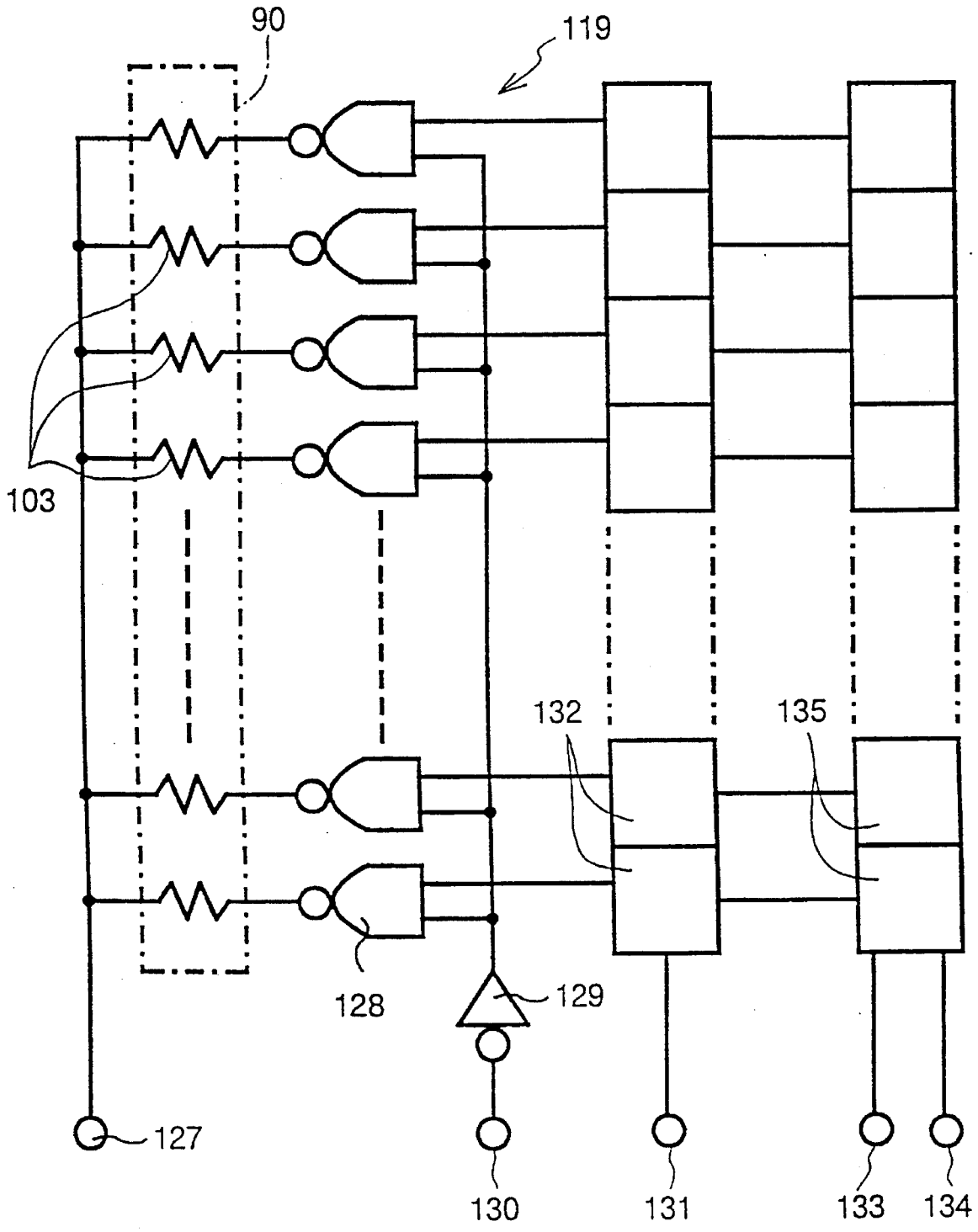
FIG. 23 is an electrical circuit diagram of a head driving circuit.

The head driving circuit 119 will now be described. As shown in FIG. 23, one electrode of each heating element 103 is connected to a power source terminal 127 of +12 V. The other electrode is connected to one of the drivers 128.

The input terminal of each driver 128 is connected to the output terminal of an invertor 129 having an input connected to a perforation strobe input terminal 130. The output terminal of the invertor 129 is also connected to the output terminal of one of the data latch circuits 132. The data latch circuits 132 are connected to a latch signal input terminal 131.

Further, the input terminal of each data latch circuit 132 is connected to the output terminal of one of the shift registers 135 whose input terminal is connected to a clock input terminal 133 and a data input terminal 134.

Figure 24:
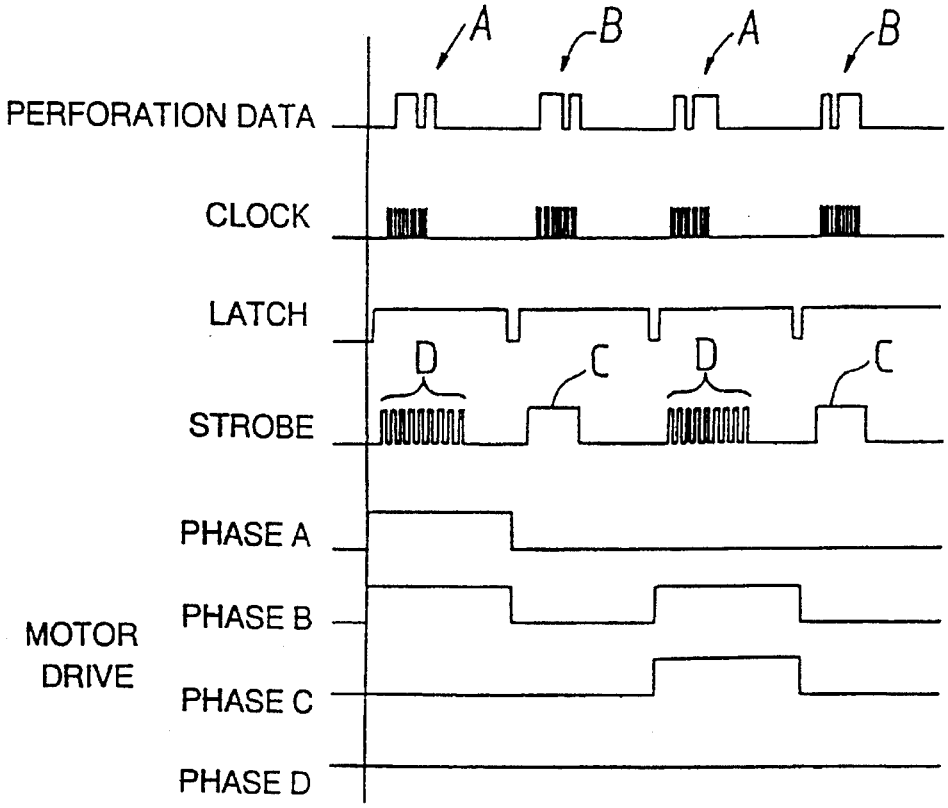
FIG. 24 is a timing chart showing typical timings of the signals input to the head driving circuit and timings of the motor driving signal.
Figure 25:
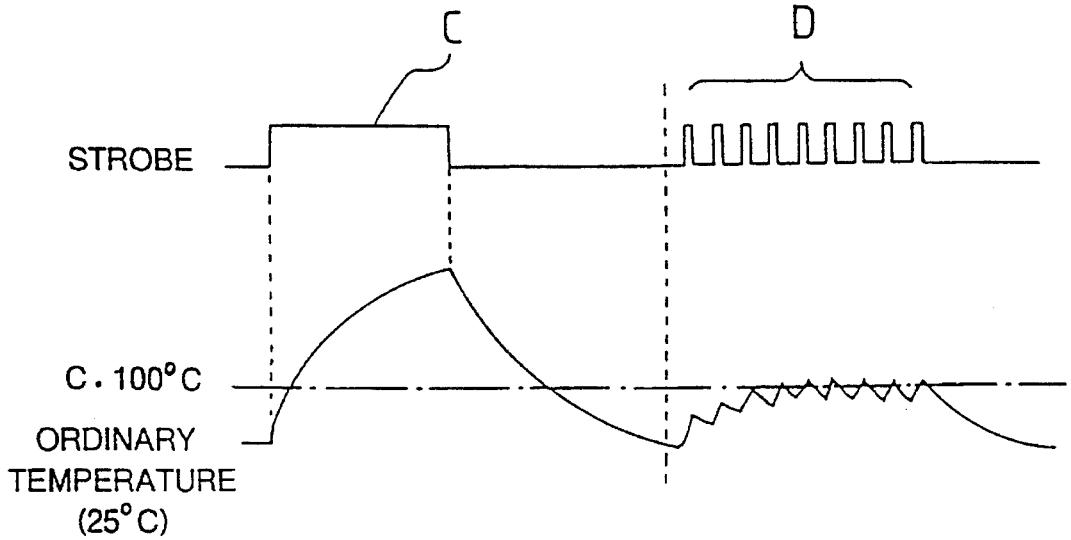
FIG. 25 is an explanatory view showing relationships between the strobe signals C and D and the temperatures of the heating elements.

FIGS. 24 and 25 show the signals input to the perforation data input terminal 134, the clock input terminal 133, the latch signal input terminal 131, the perforation strobe input terminal 130 as well as the motor driving signal output to the carriage feeding motor 100 (stepping motor) by the motor driving circuit 120. FIG. 24 is a timing chart showing a typical timing of the signals input to each input terminal of the head driving circuit 119 as well as timings of the motor driving signal output by the motor driving circuit 120.

In FIG. 24, the perforation data is generally used to perforate a character string on the print face portion 33 of the stamp unit 1 using the heating elements 103 of the thermal head 90. There are two kinds of perforation data. Data A corresponds to character data about the character string and data B prevents the sticking of the thermoplastic film 30 when it is melted to the heating elements 103. The clock signal is output in synchronism with the perforation data. In operation, the perforation data is placed into the shift register 135 in synchronism with the clock signal. The latch signal is used to latch the perforation data held in the shift register 135.

The strobe signal heats (i.e., powers) the heating elements 103 of the thermal head 90. The strobe signal occurs in two types. Strobe signal C powers the heating elements 103 to a predetermined temperature higher than the melting temperature (140°–150° C.) of the thermoplastic film 30 based on the perforation data. Strobe signal D powers the heating elements 103 to reach a temperature (around 70°–105° C.) lower than both the perforating temperature and the melting temperature (140°–150° C.) of the thermoplastic film 30 while the thermal head 90 is being moved by the carriage feeding motor 100 relative to the print face portion 33 following perforation of the character string. The heating elements 103 reach temperatures exceeding 200° C. when powered with the strobe signal C and attain temperatures between approximately 70° C. and 105° C. when powered with the strobe signal D.

The carriage feeding motor 100 connected to the motor driving circuit 120 preferably includes a four-phase (phases A, B, C and D) stepping motor. The motor driving signal sent to the carriage feeding motor 100 includes pulse signals causing the motor to rotate while switching the excitation phases two at a time as shown in FIG. 24. The method for driving the carriage feeding motor 100 by such a motor driving signal is a well known technique and accordingly will not be discussed further.

The strobe signals C and D relate to the temperatures of the heating elements 103 as will now be described with reference to FIG. 25. FIG. 25 is an explanatory view depicting relations between the strobe signals C and D on one hand and the temperatures of the heating elements 103 on the other hand. In FIG. 25, the output of the strobe signal C to the heating elements 103 causes the element surface to start rising in temperature as soon as the signal is applied. Just before the strobe signal C is turned off, the heating elements 103 are heated to more than approximately 200° C. When the strobe signal C is turned off, the temperature of the heating elements 103 drops precipitately to approximately room temperature (about 25° C.). Then the strobe signal D is output consecutively to the heating elements 103. This gradually raises the temperature of the heating elements 103 from the room temperature of about 25° C. The heating element temperature may fluctuate within a small range while being elevated. Just before the strobe signal D is turned off, the heating elements 103 are at a temperature slightly exceeding approximately 100° C. (about 105° C.). With the strobe signal D turned off, the temperature of the heating elements 103 drops again to room temperature (about 25° C.).

Next, the operation of the head driving circuit 119 will be described. In the head driving circuit 119, the perforation data is stored in the shift register 135 in synchronism with a clock signal. Thereafter, when a latch signal is supplied to the latch circuit 132, the data stored in the shift registers 135 are output to the corresponding data latch circuits 132 and stored therein.

At the same time, the data is applied to each driver 128. When a perforation pulse signal of logic "0" is then applied from the perforation strobe input terminal 130 to the input terminal of the invertor 128, a signal of logic "1" is output from the output terminal of the invertor 128 and is applied to the input terminal of each driver 128.

Accordingly, when the data of the data latch circuit 132 is a logic "1", the output side of the driver 128 is set to a logic "0" and a driving current is supplied from the power source terminal 127 to the corresponding heating element 103. At this time, the pulse width of the strobe signal C input to the strobe signal input terminal 130 is set so that the surface temperature (more than 200° C.) of the heating element 103 is suitable for heat perforation. In the manner described, the target character string is perforated on the thermoplastic film 30 of the heat sensitive stencil paper 28.

With the character string perforated on the thermoplastic film 30, the data B is placed into the shift register 135 in synchronism with the clock signal. Thereafter, when the latch signal is fed to the data latch circuits 132, the data B held in the shift register 135 is output to the corresponding data latch circuit 132 for storage therein.

At the same time, the data B is output to each of the drivers 128. The strobe signal D of a logic "0" is applied from the strobe input terminal 130 to the input terminal of the inverter 129. This causes the output terminal of the inverter 129 to output a logic "1" signal that is sent to the input terminal of each of the drivers 128.

That is, when the data in the data latch circuit 132 is at logic "1," the output side of the drivers 128 is at logic "0." This causes the power source terminal 127 to apply driving currents to the heating elements 103. At this point, the pulse width and pulse count of the strobe signal D input to the strobe input terminal 130 are set so that the surface of the heating elements 103 will reach a temperature that is lower than the melting temperature of the thermoplastic film 30 but high enough to soften the film (i.e., around 105° C.). Thus, dregs of the melted film 30 stuck to the heating elements 103 of the thermal head 90 remain in the vicinities of the perforated holes on the thermoplastic film 30.

Figure 26:
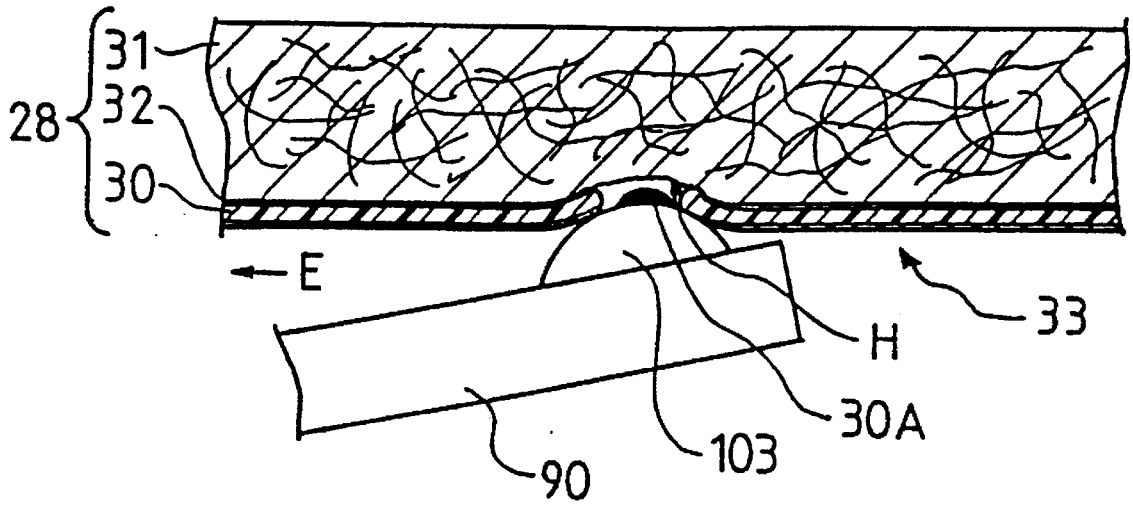
FIG. 26 is a schematic cross-sectional view showing a relationship between the heat sensitive stencil paper and the heating elements of the thermal head when perforation is being performed.
Figure 27:
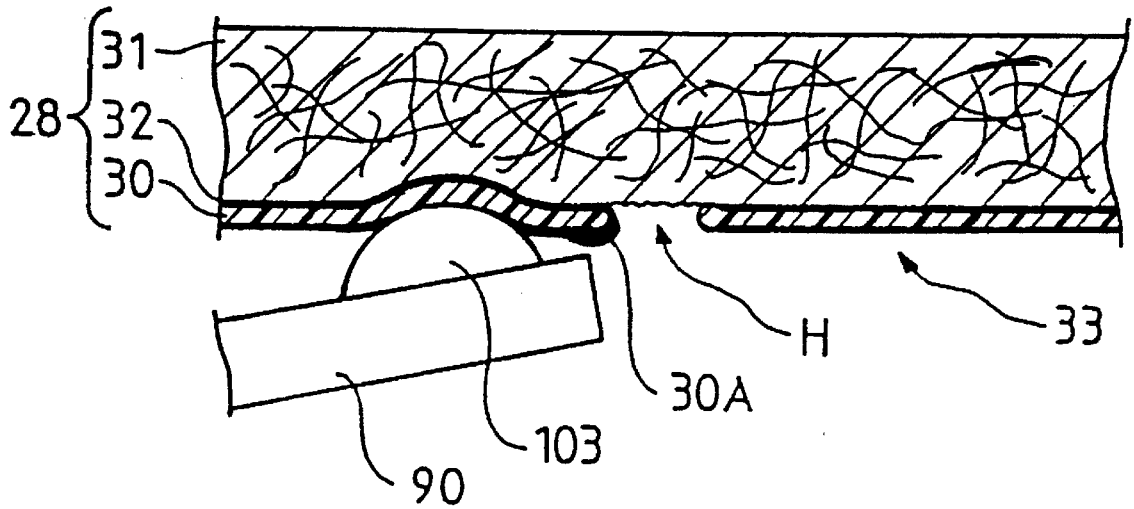
FIG. 27 is a schematic cross-sectional view showing a relationship between the heat sensitive stencil paper and the heating elements of the thermal head after the thermal head is moved.

FIGS. 26 and 27 will now be described to show an operation to perforate the character string on the thermoplastic film 30 in the print face portion 33 of the stamp unit 1 using the thermal head 90 and the carriage feeding motor 100. An operation to prevent dregs of the melted film 30 from sticking to the heating elements 103 by moving the thermal head 90 relative to the print face portion 33 will also be described. FIG. 26 shows a relationship between the heat sensitive stencil paper 28 and the heating elements 103 of the thermal head 90 when perforation is under way. The layers 30, 31 and 32 of FIGS. 26 and 27 correspond to the layers 30, 31 and 32 of FIG. 6. FIG. 27 shows a relationship between the heat sensitive stencil paper 28 and the heating elements 103 of the thermal head 90 after the thermal head 90 is moved relative to the print face portion 33.

In FIG. 26, when perforating the character string on the thermoplastic film 30 of the heat sensitive stencil paper 28, the heating elements 103 of the thermal head 90 are elastically pushed upward by the spring 97. In this state, the head driving circuit 119 powers and heats the heating elements 103 of the thermal head 90 as described. This gradually raises the temperature of the heating elements 103 based on the data A and the strobe signal C as shown in FIG. 25. The heating element temperature eventually exceeds 200° C. (the melting temperature of the thermoplastic film 30). This allows the heating elements 103 to melt the spots of the thermoplastic film which are in contact therewith. At the same time, part of the adhesive layer 32 is melted to form holes H on the heat sensitive stencil paper 28 based on the character string. The ink fed to the porous carrier 31 from the ink-soaked impregnation member 27 is then ready to seep out of the thermoplastic film 30 through the holes H.

When the holes H are being made, the thermoplastic film 30 is melted and solidifies as the heating elements 103 cool when the strobe signal C is turned off. This leaves the melted film 30A on the surface of each of the heating elements 103.

With the holes H formed on the thermoplastic film 30, the head driving circuit 119 drives the heating elements 103 based on the data B and strobe data D. This gradually raises the temperature of the heating elements 103 on the thermal head 90 gradually to about 105° C. That temperature is lower than the melting temperature of the thermoplastic film 30 and is still high enough to soften the film. Thus the melted film 30A stuck on the surface of the heating elements 103 softens. The motor driving circuit 120 then outputs the motor driving signal (see FIG. 24) to the carriage feeding motor 100. This causes the thermal head 90 and the carriage 87 to move in the direction E in FIG. 26 relative to the print face portion 33. At this point, the softened film 30A on the surface of the heating elements 103 is scraped by the edge of the holes H (center left in FIG. 27) and is removed from the heating element surface. This leaves dregs of the melted film 30A sticking to the edge of the holes H. In this manner, when the thermoplastic film 30 is thermally melted for perforation, the melted thermoplastic film 30A is prevented from sticking to the heating elements 103 of the thermal head 90. The heating elements 103 are thus kept clean at all times, which makes it possible to constantly perforate clear-cut character strings.

When the stamp unit 1 has the perforated holes H in the form of a character string, the print face portion 33 is first positioned to a desired position on the surface of a sheet through the skirt member 6. Thereafter, the operator grasps the grip portion 2 and downwardly presses the grip portion 2 to press the print face portion 33 onto the surface of the sheet. The ink in the impregnation member 27 then oozes out through the pores to print the perforation pattern on the surface of the sheet.

The skirt member 6 surrounds the outer peripheral of the stamp unit 3 and is freely movable upwardly and downwardly. The skirt member 6 is so designed to be freely moved upwardly and downwardly among the first, second and third positions. The skirt member 6 thus constructed is elastically urged to the first position so that the print face portion 33 can be perforated to form a desired pattern in a desired dot pattern when the skirt member 6 is kept at the third position.

In the printing operation, when the skirt member 6 is maintained at the first position and is set to a print position on the surface of a sheet, the print face portion 33 is positioned. The grip portion 2 is then pressed, the spring contracts and the skirt member 6 is elevated to the second position. Therefore, the print can be accurately performed at a desired position. When the press force applied to the grip portion 2 is moderated after the print, exfoliation of the sheet from the print face portion 33 is promoted due to a returning action of the skirt member 6 to the first position so that the print can be beautifully performed even on a thin sheet. When printing is performed within a narrow frame on the surface of a sheet, the print can be performed while the skirt member 6 is manually held at the second or third position.

When the device is unused, the skirt member 6 is held at the first position by the urging force of the spring 21. The whole stamp unit 1 is supported by the skirt member 6 and the print face portion 33 can be protected.

Further, the stamp unit 3 is provided with the heat sensitive stencil paper which covers the surface portion of the impregnation member 27. The stamp unit 3 further includes the holding member 5 which surrounds the outer peripheral portion of the heat sensitive stencil paper 28 extending to the outer peripheral of the base member 26 at the more inside portion than the skirt member 6. Therefore, the outer peripheral of the heat sensitive stencil paper 28 extends to the outer peripheral of the base member 26 and can be prevented from being damaged by the skirt member 6. Further, the ink can be prevented from flowing out from the impregnation member 27.

Further, the protection cap 7 covers the print face 33 of the stamp unit 3 and is mounted on the stamp unit 3. Therefore, damage of the print face portion 33 and the attachment of dust to the print face portion 33 when the device is unused can be prevented using the protection cap 7. The protection cap 7 also prevents the apparatus from printing at a position where the print is not desired due to erroneous operation.

With respect to the thermal perforating device 50, when the stamp member 1 is mounted on the perforation mount 71, the stamp member 1 is supported by the pair of front and rear guide portions which are engaged with the pair of front and rear guide grooves 15, and is pressed backwardly by the pair of rollers 81 to accurately set the position of the stamp member 1.

The stamp member 1 is engagedly secured by the engaging portion 85 and also engagedly secured at the ends of the front and rear guide grooves 15 to accurately set the position in the left and right direction. In addition, the engaging recess portion 16 of the stamp member 1 is engaged with one roller 81 so that the stamp member 1 can be prevented from being positionally deviated during the perforating operation.

The door 75 and the cam member 91 are interlocked with each other through the sector gear 76, the gear 98 and the head switching rod 89. The thermal head 90 is downwardly released until the stamp member 1 is mounted on the perforation mount 71 and the door 75 is closed. Therefore, the print face 33 can be prevented from being damaged by the thermal head 90 when the stamp member 1 is mounted. Further, when perforation is completed, the carriage 87 is moved to the left side until the thermal head 90 is moved away from the print face portion 33. Therefore, the thermal head 90 is prevented from continuously pressing the print face portion 33. Thus, ink leakage from the print face portion 33 can be prevented. Still further, when the stamp member 1 is detached after the perforation is completed, the thermal head 90 is downwardly released by opening the door 75 so that the print face portion 33 suffers no damage when the stamp member 1 is taken out.

Since the skirt member 6 is switched to the elevated third position by the guide bar 83 when the stamp member 1 is mounted on the perforation mount 71, the skirt member 6 does not obstruct the perforation when the print surface portion 33 is perforated.

The width of the stamp member 1 is detected by the contactless switches 104 and 105 so that pores of a character array not conformable to the size of the print face portion 33 are prevented from being formed due to erroneous setting of the size of the stamp member 1. Further, the stamp member 1 is supported on the perforation mount 71 through the engagement between the guide member 78 and the grip portion 2 so that both narrow-width types and wide-width types of stamp member 1 can be mounted on the perforation mount 71 if the grip portion is similarly designed. Accordingly, this device can be used extensively.

In summary, the perforating device for use with the stamp unit 1 has the heating elements 103 of the thermal head 90 perforating the holes H on the print face portion 33 of the stamp unit 1. The head driving circuit 119 first outputs the strobe signal C to the heating elements 103 based on the data A. This causes the surface of the heating elements 103 to reach a temperature exceeding 200° C. (the melting temperature of the thermoplastic film 30) so as to perforate the holes H on the print face portion 33. With the holes H thus made, the head driving circuit 119 outputs the strobe signal D to the heating elements based on the data B. This brings the surface temperature of the heating elements 30 to about 105° C. which is lower than the melting temperature of the thermoplastic film 230 but still high enough to soften the film. With that state maintained, the motor driving circuit 120 outputs the motor driving signal to the carriage feeding motor 100 to move the thermal head 90 relative to the print face portion 33. This causes the edge of the holes H to scrape the melted film 30A stuck on the surface of the heating elements 103 and to remove the melted film 30A from the heating element surface. This leaves the dregs of the removed film 30A at the edge of the holes H. In this manner, when the thermoplastic film 30 is thermally perforated, it is possible to unfailingly prevent the sticking of the melted thermoplastic film 30A to the heating elements 103 of the thermal head 90. With the heating elements 103 kept clean at all times, clear-cut character strings are constantly perforated.

Although the above description contains many particularities, these should not be construed as limiting the scope of the invention but as merely providing illustrations of the presently preferred embodiment. For example, although the above embodiment drives the heating elements 103 according to the strobe signals C and D during perforation of the holes H in order to remove the melted film 30A from the heating element surface, this is not limitative of the invention. Alternatively, the heating elements may be powered and heated for removal of melted film dregs using different timings from the strobe signals C and D. Accordingly, other embodiments of the present invention are also within the scope of this invention.

What is claimed is:

1. A perforating device used by a stamp unit for perforating a desired character string pattern on a print face portion of said stamp unit having an ink impregnation member covered with a heat sensitive stencil paper including a thermoplastic film, said perforating device comprising:

a thermal head having a plurality of heating elements selectively heated to a first temperature to melt and perforate portions of said thermoplastic film based on the desired character string pattern;

moving means for moving said thermal head and said print face portion relative to each other after said thermal head has perforated said film; and head driving means for heating said heating elements to a second temperature after said thermal head has perforated said film, the second temperature being less than said first temperature.

2. The perforating device of claim 1, wherein the first temperature is greater than a melting temperature of said thermoplastic film and the second temperature is less than the melting temperature of said thermoplastic film.

3. The perforating device of claim 1, wherein the head driving means causes portions of the film adhering to the heating elements to soften when heated to the second temperature.

4. The perforating device of claim 1, wherein the moving means includes a carriage supporting said thermal head, said carriage moving relative to the print face portion.

5. The perforating device of claim 1, wherein the moving means moves said thermal head such that portions of the film adhering to the heating elements are removed from the heating elements when the thermal head is moved.

6. The perforating device of claim 1, wherein the second temperature is sufficient to remove portions of the film from heating elements that are adhering to the heating elements when said moving means moves said thermal head and said print face portion relative to each other, the second temperature being insufficient to further melt and perforate said film on the print face portion.

7. The perforating device of claim 1, wherein the head driving means heats said heating elements to the second temperature prior to the moving means moving said thermal head and said print face position relative to each other.

8. The perforating device of claim 7, wherein the head driving means maintains said heating elements at the second temperature as the moving means moves said thermal head and said print face portion relative to each other.

9. A perforating device for perforating a desired character string pattern on a print face portion of a stamp unit, the print face portion including a film, the perforating device comprising:

a thermal head having a plurality of heating elements;

a heating device for heating the heating elements to a first temperature and a second temperature, the second temperature being less than the first temperature;

a moving device that moves one of the print face portion and the thermal head; and a controller connected to the heating device to heat the heating elements to the first temperature and perforate portions of the film, the controller controlling the heating device to heat the heating elements to the second temperature after portions of the film have been perforated, the controller controlling the moving device to move the one of the print face portion and the thermal head after portions of the film have been perforated.

10. The perforating device of claim 9, wherein the first temperature is greater than a melting temperature of the film and the second temperature is less than the melting temperature of the film.

11. The perforating device of claim 9, wherein the moving device includes a carriage to move the thermal head supporting the heating elements.

12. The perforating device of claim 11, wherein the controller controls the carriage to move the carriage and remove portions of the film from the heating elements that are adhering to the heating elements.

13. The perforating device of claim 9, wherein the first temperature is a temperature sufficient to melt portions of the film.

14. The perforating device of claim 9, wherein the second temperature is a temperature sufficient to soften portions of the film adhering to the heating elements but insufficient to further melt said film on the print face portion.

15. The perforating device of claim 9, wherein the controller controls the perforating device such that the heating device heats the heating elements to the second temperature prior to the moving device moving the one of the print face portion and the thermal head.

16. The perforating device of claim 15, wherein the controller controls the perforating device such that the heating device maintains said heating elements at the second temperature as the moving device moves said thermal head and said print face portion relative to each other.

17. A method of perforating a desired character string pattern on a print face portion of a stamp unit, the print face portion having a film, the method comprising the steps of:

heating select heating elements of a thermal head to a first temperature to perforate portions of the film;

heating said heating elements to a second temperature after portions of the film have been perforated, the second temperature being less than the first temperature; and moving one of said heating elements and said print face portion to remove portions of said film from the heating elements that are adhering to the heating elements after the heating elements are heated to the second temperature.

18. The method of claim 17, further comprising the step of allowing the heating elements to cool from said first temperature prior to heating the heating elements to the second temperature.

19. The method of claim 17, wherein the thermal head is supported on a carriage, the moving step comprising moving the carriage supporting the heating elements when the heating elements are heated to the second temperature.

20. The method of claim 17, wherein the second temperature is sufficient to remove portions of the film adhering to the heating elements when said one of the heating elements and the print face portion are moved, the second temperature being insufficient to further perforate portions of said film.

* * * * *